US010226100B2

(12) United States Patent
Auger

(10) Patent No.: US 10,226,100 B2
(45) **Date of Patent: *Mar. 12, 2019**

(54) SOLE ASSEMBLY INCLUDING A CENTRAL SUPPORT STRUCTURE FOR AN ARTICLE OF FOOTWEAR

(71) Applicant: NIKE, Inc., Beaverton, OR (US)

(72) Inventor: Perry W. Auger, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/255,886

(22) Filed: Sep. 2, 2016

(65) Prior Publication Data

US 2016/0366977 A1 Dec. 22, 2016

Related U.S. Application Data

(63) Continuation of application No. 13/483,160, filed on May 30, 2012, now Pat. No. 9,468,251.

(51) Int. Cl.
*A43B 3/00* (2006.01)
*A43B 5/02* (2006.01)
(Continued)

(52) U.S. Cl.
CPC ..... *A43B 13/186* (2013.01); *A43B 3/0036* (2013.01); *A43B 5/02* (2013.01);
(Continued)

(58) Field of Classification Search
CPC ..... A43B 3/0068; A43B 5/02; A43B 13/14; A43B 13/141; A43B 13/26; A43B 13/223
(Continued)

(56) References Cited

U.S. PATENT DOCUMENTS

D52,217 S 7/1918 Haynes
D136,208 S 8/1943 Ghez et al.
(Continued)

FOREIGN PATENT DOCUMENTS

CN 1822776 A 8/2006
CN 101896089 A 11/2010
(Continued)

OTHER PUBLICATIONS

United States Patent and Trademark Office, Office Action for U.S. Appl. No. 13/483,160, dated Jan. 15, 2015.
(Continued)

*Primary Examiner* — Sharon M Prange
(74) *Attorney, Agent, or Firm* — Honigman LLP; Matthew H. Szalach; Jonathan P. O'Brien

(57) ABSTRACT

A sole assembly for an article of footwear is disclosed. The sole assembly includes a central support structure that extends along the sole assembly in the longitudinal direction. The sole assembly includes forefoot wing portions extending away from the central support structure in the lateral direction in the forefoot region of the sole assembly. The sole assembly also includes stability rib portions extending away from the central support structure in the lateral direction in the midfoot region of the sole assembly. The central support structure provides varying amounts of stiffness and flexibility to the sole assembly and the forefoot wing portions and stability rib portions provide additional stiffness and flexibility to desired portions of the sole assembly.

18 Claims, 17 Drawing Sheets

(51) Int. Cl.

| | |
|---|---|
| ***A43B 13/14*** | (2006.01) |
| ***A43B 13/18*** | (2006.01) |
| ***A43B 13/12*** | (2006.01) |
| ***A43B 23/22*** | (2006.01) |
| ***A43B 7/24*** | (2006.01) |
| ***A43B 13/04*** | (2006.01) |
| ***A43B 13/22*** | (2006.01) |
| ***A43C 15/16*** | (2006.01) |

(52) U.S. Cl.
CPC ..... *A43B 7/24* (2013.01); *A43B 13/04* (2013.01); *A43B 13/122* (2013.01); *A43B 13/141* (2013.01); *A43B 13/181* (2013.01); *A43B 13/184* (2013.01); *A43B 13/188* (2013.01); *A43B 13/223* (2013.01); *A43B 23/22* (2013.01); *A43B 23/227* (2013.01); *A43C 15/161* (2013.01)

(58) Field of Classification Search
USPC ..... 36/25 R, 59 R, 67 A, 103, 114, 128
See application file for complete search history.

(56) References Cited

U.S. PATENT DOCUMENTS

| | | | | |
|---|---|---|---|---|
| 4,180,923 | A | 1/1980 | Dassler | |
| 4,454,662 | A * | 6/1984 | Stubblefield | A43B 5/00 36/102 |
| 4,642,917 | A | 2/1987 | Ungar | |
| D294,655 | S | 3/1988 | Heyes | |
| 4,858,343 | A * | 8/1989 | Flemming | A43B 13/26 36/128 |
| 5,046,267 | A * | 9/1991 | Kilgore | A43B 5/00 36/114 |
| 5,070,629 | A | 12/1991 | Graham et al. | |
| 5,437,112 | A | 8/1995 | Johnston | |
| 5,461,801 | A * | 10/1995 | Anderton | A43B 3/0052 24/713.4 |
| D402,095 | S | 12/1998 | Cretinon | |
| 5,926,974 | A | 7/1999 | Friton | |
| 6,018,889 | A | 2/2000 | Friton | |
| 6,105,279 | A | 8/2000 | Bouchoms | |
| D437,989 | S | 2/2001 | Cass | |
| 6,199,303 | B1 | 3/2001 | Luthi et al. | |
| 6,216,365 | B1 | 4/2001 | Cohen | |
| D447,855 | S | 9/2001 | Bramani | |
| D476,143 | S | 6/2003 | McDowell | |
| D504,205 | S | 4/2005 | Andrews-Kramer | |
| 6,973,746 | B2 * | 12/2005 | Auger | A43B 1/0072 36/128 |
| 7,353,627 | B2 | 4/2008 | Briant et al. | |
| D571,092 | S | 6/2008 | Norton | |
| 7,421,805 | B2 * | 9/2008 | Geer | A43B 3/0036 36/102 |
| 7,503,132 | B2 | 3/2009 | Mason | |
| 7,647,709 | B2 * | 1/2010 | Reilly | A43B 7/142 36/107 |
| 7,818,897 | B2 | 10/2010 | Geer | |
| 7,941,945 | B2 * | 5/2011 | Gerber | A43B 13/145 36/134 |
| 7,997,013 | B2 * | 8/2011 | Reilly | A43B 7/142 36/107 |
| 8,522,457 | B2 * | 9/2013 | Scholz | A43B 13/141 36/102 |
| 2003/0029059 | A1 | 2/2003 | Favreau et al. | |
| 2003/0084592 | A1 | 5/2003 | Ho | |
| 2005/0034328 | A1 | 2/2005 | Geer | |
| 2009/0090027 | A1 | 4/2009 | Baudouin | |
| 2009/0100718 | A1 | 4/2009 | Gerber | |
| 2009/0113758 | A1 | 5/2009 | Nishiwaki et al. | |
| 2009/0199434 | A1 | 8/2009 | Perron, Jr. | |
| 2010/0212190 | A1 | 8/2010 | Schmid | |
| 2011/0088287 | A1 * | 4/2011 | Auger | A43B 5/02 36/107 |
| 2011/0126428 | A1 | 6/2011 | Hazenberg et al. | |
| 2011/0214314 | A1 * | 9/2011 | Baker | A43B 13/183 36/134 |
| 2011/0247235 | A1 * | 10/2011 | de Roode | A43B 7/142 36/44 |

FOREIGN PATENT DOCUMENTS

| | | | |
|---|---|---|---|
| FR | 2549702 | B1 | 10/1987 |
| JP | 2001299404 | A | 10/2001 |
| JP | 2001340101 | A | 12/2001 |
| JP | 2002306207 | A | 10/2002 |
| JP | 2009142705 | A | 7/2009 |
| KR | 100733154 | B1 | 6/2007 |
| WO | WO-2005009162 | A2 | 2/2005 |

OTHER PUBLICATIONS

United States Patent and Trademark Office, Office Action for U.S. Appl. No. 13/483,160, dated Jul. 28, 2015.
United States Patent and Trademark Office, Office Action for U.S. Appl. No. 13/483,160, dated Jan. 19, 2016.
State Intellectual Property Office of the People'S Republic of China, Office Action for CN Application No. 20130027576.0, dated May 9, 2016.
Japan Patent Office, Office Action for JP Application No. P2015-515120, dated Dec. 28, 2015.
European Patent Office, Extended European Search Report for EP Application No. 15001450, dated Oct. 29, 2015.
State Intellectual Property Office of the People's Republic of China, Office Action for CN Application No. 201380027576.0, dated Sep. 14, 2015.
International Searching Authority, International Search Report and Written Opinion for International Application No. PCT/US2013/042971, dated Sep. 12, 2013.
International Searching Authority, International Preliminary Examination Report and Written Opinion for International Application No. PCT/US2013/042971, dated Dec. 11, 2014.
State Intellectual Property Office (PRC), Office Action for CN Application No. 201710080028.4, dated Jul. 17, 2018.
European Patent Office, Extended European Search Report for EP Application No. 18000158.8, dated May 24, 2018.

* cited by examiner

SOLE ASSEMBLY INCLUDING A CENTRAL SUPPORT STRUCTURE FOR AN ARTICLE OF FOOTWEAR

CROSS-REFERENCE TO RELATED APPLICATION(S)

This application is a continuation of co-pending application Ser. No. 13/483,160 filed on May 30, 2012, which is incorporated herein by reference in its entirety.

BACKGROUND

The present invention relates generally to articles of footwear, and in particular to a sole assembly including a central support structure for an article of footwear.

Articles of footwear generally include two primary elements: an upper and a sole assembly. The upper may be formed from a variety of materials that are stitched or adhesively bonded together to form a void within the footwear for comfortably and securely receiving a foot. The sole assembly is secured to a lower portion of the upper and is generally positioned between the foot and the ground. In many articles of footwear, including athletic footwear styles, the sole assembly often incorporates an insole, a midsole, and/or an outsole. The sole assembly can also simply incorporate an outsole.

Depending on the type of article of footwear provided, various types of sole assemblies can be selected having different amounts of support, cushioning, stability, stiffness, and flexibility. Generally, providing a sole assembly having one characteristic can limit the amount of another characteristic that can be simultaneously provided. For example, a sole assembly having a high amount of support or stability may have a low amount of flexibility. Similarly, a sole assembly with a high amount of cushioning may not be able to also provide a high amount of stiffness.

Therefore, there exists a need in the art for a sole assembly for an article of footwear that provides support and stiffness to portions of the article and also provides flexibility to other portions of the article.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
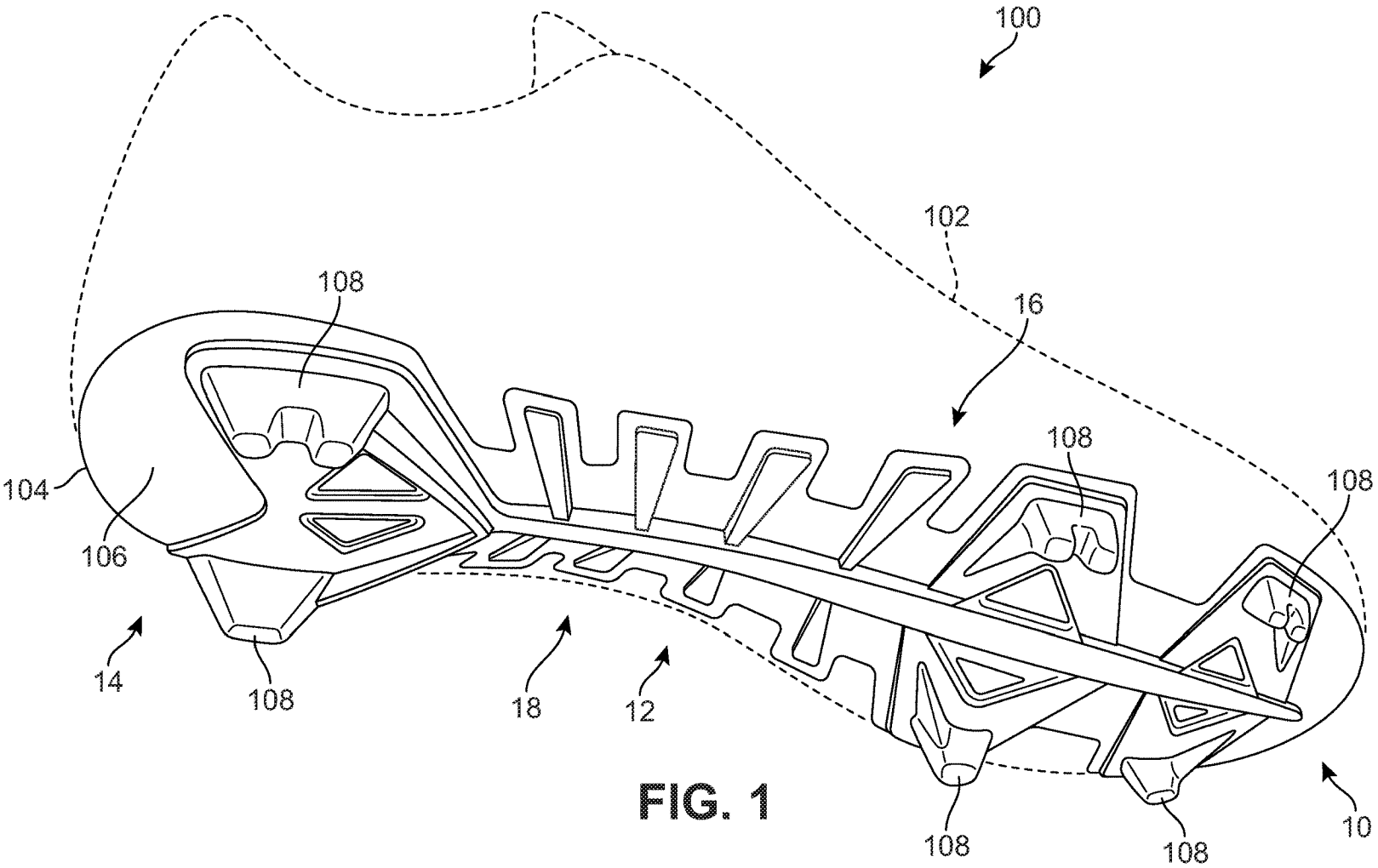
FIG. 1 is an isometric view of an exemplary embodiment of an article of footwear with a sole assembly including a central support structure.

In one aspect, the invention provides an article of footwear comprising: an upper; a sole assembly associated with the upper; the sole assembly having a forefoot region, a midfoot region, and a heel region, the sole assembly further including a central support structure disposed longitudinally along the sole assembly from the forefoot region to the heel region; the central support structure being disposed on a bottom surface of the sole assembly and extending away from the bottom surface in a vertical direction; wherein the central support structure has a first thickness at the forefoot region of the sole assembly and a second thickness at the midfoot region of the sole assembly; and wherein the first thickness is smaller than the second thickness.

In another aspect, the invention provides an article of footwear comprising: an upper; a sole assembly associated with the upper; the sole assembly having a forefoot region, a midfoot region, and a heel region, the sole assembly further including a central support structure disposed longitudinally along the sole assembly from the forefoot region to the heel region; the central support structure being disposed on a bottom surface of the sole assembly and extending away from the bottom surface in a vertical direction; a plurality of forefoot wing portions disposed in the forefoot region of the sole assembly, the forefoot wing portions extending away from the central support structure in a lateral direction; and wherein the forefoot wing portions increase in thickness from the central support structure towards a peripheral edge.

In another aspect, the invention provides an article of footwear comprising: an upper; a sole assembly associated with the upper; the sole assembly having a forefoot region, a midfoot region, and a heel region, the sole assembly further including a central support structure disposed longitudinally along the sole assembly from the forefoot region to the heel region; the central support structure being disposed on a bottom surface of the sole assembly and extending away from the bottom surface in a vertical direction; a plurality of stability rib portions disposed in the midfoot region of the sole assembly, the stability rib portions extending away from the central support structure in a lateral direction; and wherein at least one stability rib element of the plurality of stability rib portions is disposed at a different height along the central support structure than the remaining stability rib portions.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

A sole assembly for an article of footwear including a central support structure is disclosed. The central support structure may be configured to provide varying amounts of stiffness to different portions of the sole assembly to tune the amount of flexibility and support provided to a foot disposed in the article of footwear. FIGS. 1-11 illustrate an exemplary embodiment of a sole assembly 104 that may be incorporated into an article of footwear 100. Article of footwear 100, also referred to simply as article 100, incorporating sole assembly 104 may be any type of footwear including, but not limited to: hiking boots, soccer shoes, football shoes, sneakers, rugby shoes, basketball shoes, baseball shoes as well as other kinds of shoes. As shown in FIGS. 1-11, article of footwear 100 is intended to be used with a left foot; however, it should be understood that the following discussion may equally apply to a mirror image of article 100 that is intended for use with a right foot.

In some embodiments, sole assembly 104 may be associated with upper 102 to form article 100. FIG. 1 is an isometric view of article of footwear 100 from a medial side. For purposes of reference, article 100 may be divided into forefoot region 10, midfoot region 12, and heel region 14. Forefoot region 10 may be generally associated with the toes and joints connecting the metatarsals with the phalanges. Midfoot region 12 may be generally associated with the arch of a foot. Likewise, heel region 14 may be generally associated with the heel of a foot, including the calcaneus bone. In addition, article 100 may include medial side 16 and lateral side 18. In particular, medial side 16 and lateral side 18 may be opposing sides of article 100. Furthermore, both medial side 16 and lateral side 18 may extend through forefoot region 10, midfoot region 12, and heel region 14.

It will be understood that forefoot region 10, midfoot region 12, and heel region 14 are only intended for purposes of description and are not intended to demarcate precise regions of article 100. Likewise, medial side 16 and lateral side 18 are intended to represent generally two sides of an article, rather than precisely demarcating article 100 into two halves. In addition, forefoot region 10, midfoot region 12, and heel region 14, as well as medial side 16 and lateral side 18, can also be applied to individual components of an article, such as a sole assembly, an upper, and/or associated components or elements.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot region to a heel region of the article. Also, the term "lateral" as used throughout this detailed description and in the claims refers to a direction extending a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. It will be understood that each of these directional adjectives may be applied to individual components of an article, such as an upper and/or a sole assembly.

In various embodiments, upper 102 may be attached to sole assembly 104 by any known mechanism or method to form article 100. For example, upper 102 may be stitched to sole assembly or upper 102 may be glued or bonded to sole assembly 104. Upper 102 may be configured to receive a foot. Generally, upper 102 may be any type of upper. In particular, upper 102 may have any design, shape, size and/or color. For example, in embodiments where article 100 is a soccer shoe, upper 102 may be a low top upper. In embodiments where article 100 is a football shoe, upper 102 may be a high top upper that is shaped to provide high support on an ankle. In other embodiments, upper 102 may include another type of design, including designs associated with various sports for which article 100 may be configured. Upper 102 may be made from one or more conventional materials, including, but not limited to woven or non-woven fabrics, nylon, natural leather, synthetic leather, natural rubber, synthetic rubber, other suitable materials and combinations thereof.

In some embodiments, sole assembly 104 may be configured to provide traction for article 100. In addition to providing traction, sole assembly 104 may attenuate ground reaction forces between the foot and the ground during walking, running or other ambulatory activities, to provide support and/or stability to the foot. The configuration of sole assembly 104 may vary significantly in different embodiments to include a variety of conventional or non-conventional structures. Sole assembly 104 extends between upper 102 and the ground when article 100 is worn. In different embodiments, sole assembly 104 may include different components. For example, sole assembly 104 may include an outsole, a midsole, and/or an insole. In some cases, one or more of these components may be optional.

Sole assembly 104 may be made from materials known in the art for making articles of footwear. For example, sole assembly 104 may be made from elastomers, siloxanes, natural rubber, synthetic rubbers, aluminum, steel, natural leather, synthetic leather, carbon fiber, plastics, or thermoplastics, including, but not limited to Pebax® or other thermoplastic elastomers; thermoplastic polyurethane (TPU).

Referring to FIG. 1, in an exemplary embodiment, sole assembly 104 may be configured as an outsole plate extending substantially through forefoot region 10, midfoot region 12, and heel region 14. In other embodiments, however, sole assembly may be configured with additional components of a sole assembly, including one or more of an insole and/or midsole. In still other embodiments, sole assembly 104 may be associated with a base plate having a shape corresponding generally to a shape of a bottom of upper 102 and the components of sole assembly 104 described in the various embodiments herein may be arranged or disposed on the base plate.

In some embodiments, sole assembly 104 may include a bottom surface 106 that is disposed on a bottom side of sole assembly 104 that is opposite a top side that is configured to confront a foot and/or upper 102. In some embodiments, sole assembly 104 may be provided with one or more types of traction elements with various arrangements on bottom surface 106 of sole assembly 104. The term "traction elements" as used in this detailed description and throughout the claims includes any provisions disposed on a sole assembly for increasing traction through friction or penetration of a ground surface, including, but not limited to cleats, studs, projections, or treads. Typically, traction elements may be configured for football, soccer, baseball or any type of activity that requires traction with a ground surface.

In an exemplary embodiment, sole assembly 104 may include one or more traction elements 108 that extend away from bottom surface 106 of sole assembly 104. Generally, traction elements 108 may be associated with sole assembly 104 in any manner. In some embodiments, traction elements 108 may be integrally formed with sole assembly 104. In other embodiments, traction elements 108 may be removably attached to sole assembly 104, such as by being screwed into holes within sole assembly 104 or using any other provisions. Still further, in some cases, some traction elements may be integrally formed with sole assembly 104, while other traction elements may be removably attached to sole assembly 104.

In some embodiments, one or more of traction elements 108 may include features to provide reinforcement to the traction elements, increase traction, and facilitate ground penetration and extraction. In some embodiments, traction elements 108 may be provided with one or more elongate support members extending from bottom surface 106 of sole assembly 104 and abutting the side portions of the traction elements. Elongate support members may have any shape or configuration, including any of the various embodiments described in one or more of co-pending U.S. application Ser. No. 13/234,180, filed on Sep. 16, 2011, entitled "Shaped Support Features For Footwear Ground-Engaging Members," U.S. application Ser. No. 13/234,182, filed on Sep. 16, 2011, entitled "Orientations For Footwear Ground-Engaging Member Support Features," U.S. application Ser. No. 13/234,183, filed on Sep. 16, 2011, entitled "Spacing For Footwear Ground-Engaging Member Support Features," and U.S. application Ser. No. 13/234,185, filed on Sep. 16, 2011, entitled "Sole Arrangement With Ground-Engaging Member Support Features," all of these applications are hereby incorporated by reference in their entirety.

Figure 2:
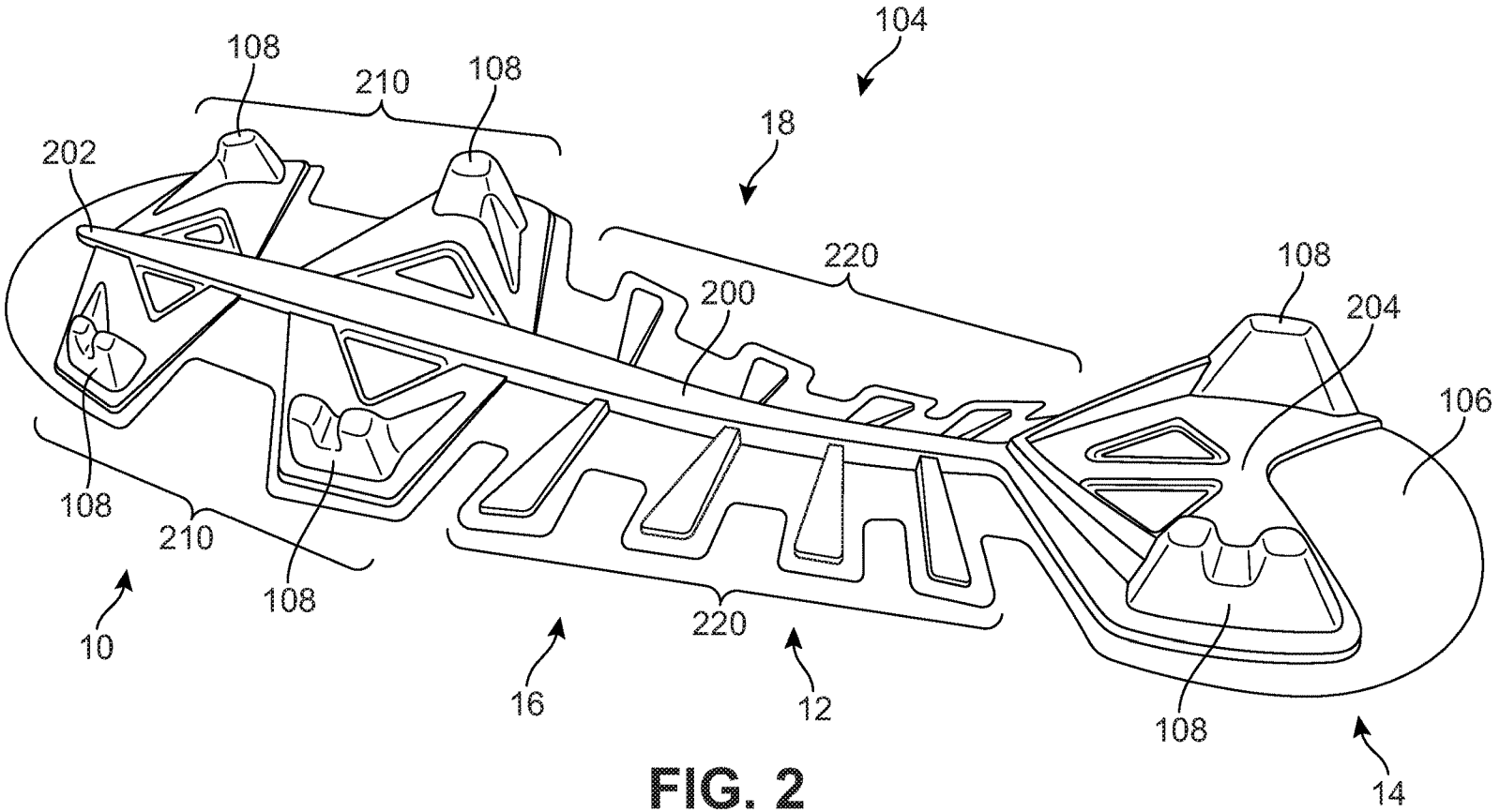
FIG. 2 is an isometric view of an exemplary embodiment of a sole assembly including a central support structure.

Referring now to FIG. 2, in some embodiments, sole assembly 104 may include various components that are configured to provide varying amounts of stiffness to different portions of sole assembly 104 to tune the amount of flexibility and support provided to a foot disposed in article of footwear 100.

In some embodiments, sole assembly 104 may include a central support structure 200. In an exemplary embodiment, central support structure 200 may be raised above bottom surface 106 of sole assembly 104 to provide stiffness to sole assembly 104. Central support structure 200 may be configured to extend longitudinally through sole assembly 104. In an exemplary embodiment, central support structure 200 may extend in a longitudinal direction along sole assembly 104 through each of forefoot region 10, midfoot region 12, and heel region 14. In this embodiment, central support structure 200 extends from a first end 202 disposed proximate a periphery of sole assembly 104 at forefoot region 10 to a second end 204 disposed at heel region 14 of sole assembly 104. With this arrangement, central support structure 200 extends in a longitudinal direction a substantial majority of the length of sole assembly.

In other embodiments, central support structure 200 may extend in the longitudinal direction more or less distance along the longitudinal direction of sole assembly 104. For example, in one embodiment, central support structure 200 may extend longitudinally through the entirety of sole assembly 104 from a periphery at forefoot region 10 to a periphery at heel region 14. In another embodiment, central support structure 200 may extend longitudinally through forefoot region 10 and midfoot region 12 and only a portion or none of heel region 14.

In some embodiments, sole assembly 104 may include one or more components that are configured to extend away from central support structure 200 in an approximately lateral direction. In an exemplary embodiment, sole assembly 104 may include a plurality of forefoot wing portions 210. Forefoot wing portions 210 may be configured to be raised above bottom surface 106 of sole assembly 104 in forefoot region 10. Forefoot wing portions 210 may be further configured to extend away from central support structure 200 in approximately a lateral direction. In an exemplary embodiment, forefoot wing portions 210 may have a generally trapezoidal shape. In other embodiments, forefoot wing portions 210 may have any shape, including, but not limited to triangular, square, rectangular, circular, ovoid, and any other regular and irregular geometric and non-geometric shapes.

In some embodiments, one or more forefoot wing portions 210 may be disposed on each of medial side 16 and lateral side 18 of sole assembly 104. In some cases, forefoot wing portions 210 may be disposed in opposing pairs on medial side 16 and lateral side 18 of sole assembly 104. In this embodiment, sole assembly 104 includes four forefoot wing portions 210 disposed in forefoot region 10, including two sets of forefoot wing portions 210 disposed on each of medial side 16 and lateral side 18. As shown in FIG. 2, forefoot wing portions 210 are disposed in matching pairs on opposing sides of sole assembly 104. In other embodiments, however, sole assembly 104 may include a larger or smaller number of forefoot wing portions 210, including equal or unequal numbers of forefoot wing portions disposed on medial side 16 and/or lateral side 18.

As will be further described below, forefoot wing portions 210 may be configured to provide flexion along the lateral direction of sole assembly 104 at forefoot region 10. In some embodiments, forefoot wing portions 210 may be associated with traction elements 108. In some cases, one or more traction elements 108 may be disposed on forefoot wing portions 210. In an exemplary embodiment, traction elements 108 may be integrally formed with forefoot wing portions 210. In this embodiment, one traction element 108 is associated with each forefoot wing portion 210. With this arrangement, forefoot wing portions 210 may be configured to alleviate pressure from the interaction of traction elements 108 with a ground surface on the foot of a wearer by dispersing pressure from traction elements 108 over forefoot wing portions 210. In other cases, a larger or smaller number of traction elements 108 may be associated with forefoot wing portions 210, including removably attached or omitted entirely.

In an exemplary embodiment, sole assembly 104 may further include a plurality of stability rib portions 220. Stability rib portions 220 may be configured to be raised above bottom surface 106 of sole assembly 104 in midfoot region 12. Stability rib portions 220 may be further configured to extend away from central support structure 200 in approximately a lateral direction. In an exemplary embodiment, stability rib portions 220 may have a generally elongated trapezoidal shape. In other embodiments, stability rib portions 220 may have any shape, including, but not limited to triangular, square, rectangular, circular, ovoid, and any other regular and irregular geometric and non-geometric shapes.

In some embodiments, one or more stability rib portions 220 may be disposed on each of medial side 16 and lateral side 18 of sole assembly 104. In some cases, stability rib portions 220 may be disposed in opposing pairs on medial side 16 and lateral side 18 of sole assembly 104. In this embodiment, sole assembly 104 includes eight individual stability rib elements disposed in midfoot region 12, including four stability rib elements associated with stability rib portions 220 disposed on each of medial side 16 and lateral side 18. As shown in FIG. 2, stability rib portions 220 are disposed in matching pairs on opposing sides of sole assembly 104. In other embodiments, however, sole assembly 104 may include a larger or smaller number of stability rib elements associated with stability rib portions 220, including equal or unequal numbers of stability rib elements disposed on medial side 16 and/or lateral side 18. In addition, in some embodiments, stability rib portions 220 may extend throughout midfoot region 12 and extend into a portion of forefoot region 10 and/or heel region 14.

As will be further described below, stability rib portions 220 may be configured to provide varying amounts of stiffness and support along the lateral direction of sole assembly 104 at midfoot region 12. In addition, in embodiments where stability rib portions 220 extend into a portion of forefoot region 10 and/or heel region 14, stability rib portions 220 may provide stiffness and support to sole assembly 104 at forefoot region 10 and/or heel region 14 as well.

In an exemplary embodiment, central support structure 200, together with forefoot wing portions 210 and/or stability rib portions 220, may have the appearance of a fishbone or similar configuration. With this arrangement, central support structure 200 may provide support and stiffness along the longitudinal direction of sole assembly 104 and forefoot wing portions 210 and/or stability rib portions 220 may provide support and stiffness along the lateral direction of sole assembly 104. In addition, as will be further described below, by varying the arrangement and/or configuration of individual stability rib elements of stability rib portions 220, varying amounts of torsional stiffness may be provided to sole assembly 104 when twisting or rotating around the longitudinal direction. Accordingly, central support structure 200, forefoot wing portions 210, and/or stability rib portions 220 may be configured in different ways to specifically tune the stiffness and/or flexibility of sole assembly 104 along the longitudinal direction and lateral direction, including torsional stiffness and flexibility when twisted or rotated around the longitudinal direction.

In different embodiments, central support structure 200, forefoot wing portions 210, and/or stability rib portions 220 may be made of various kinds of materials. Examples of different kinds of materials that may be used include, but are not limited to: metals, polymers, plastics, thermoplastics, foams, rubbers, composite materials, as well as any other kinds of materials, including any materials disclosed above for sole assembly 104.

Figure 3:
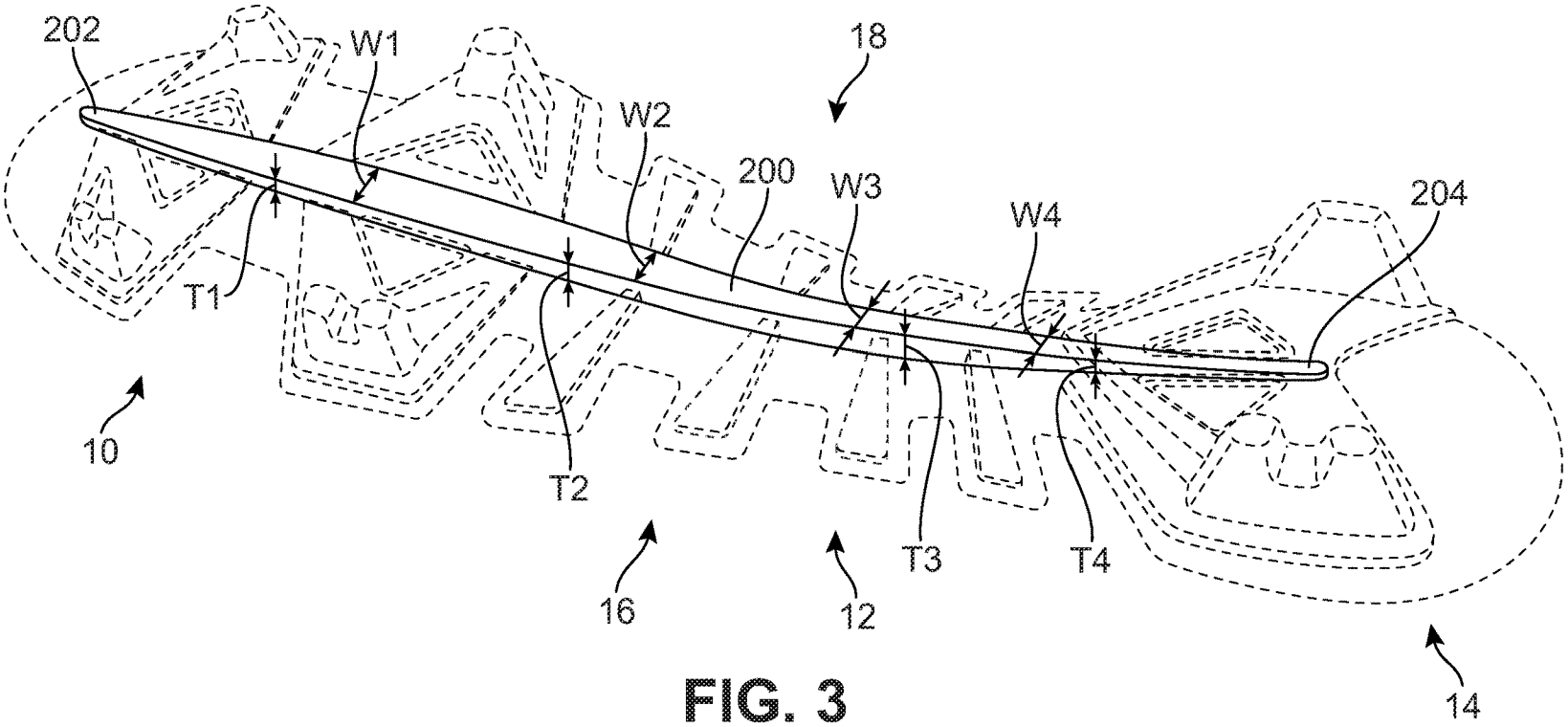
FIG. 3 is a schematic view of an exemplary embodiment of a central support structure associated with a sole assembly shown in phantom.

In some embodiments, central support structure 200 may be varied in thickness in the vertical direction and/or varied in width in the lateral direction to provide varying amounts of stiffness and/or flexibility to different portions of sole assembly 104. Referring now to FIG. 3, a schematic view of an exemplary embodiment of central support structure 200 is shown with the rest of sole assembly 104 shown in phantom. In one embodiment, central support structure 200 may be configured with a varying thickness along the longitudinal direction. With this arrangement, different amounts of stiffness and flexibility may be provided to different portions of sole assembly 104.

In this embodiment, the thickness of central support structure 200 may generally increase from first end 202 towards second end 204. For example, a portion of central support structure 200 disposed in forefoot region 10 adjacent to first end 202 may be associated with a first thickness T1. First thickness T1 may be generally thinner than the remaining portions of central support structure 200. Moving in the longitudinal direction towards second end 204, a portion of central support structure 200 disposed in forefoot region 10 adjacent to midfoot region 12 may be associated with a second thickness T2. Second thickness T2 may be larger than first thickness T1. Continuing in the longitudinal direction, a portion of central support structure 200 disposed in midfoot region 12 may be associated with a third thickness T3. Third thickness T3 may be larger than second thickness T2 and first thickness T1. In this embodiment, central support structure 200 may gradually increase in thickness from first thickness T1 to second thickness T2 to third thickness T3. In other embodiments, however, increases in thickness of central support structure 200 may be abrupt or uneven.

In this embodiment, the portion of central support structure 200 associated with third thickness T3 may be the largest thickness of central support structure. In an exemplary embodiment, central support structure 200 may decrease in thickness from third thickness T3 towards second end 204 in heel region 14. A portion of central support structure 200 disposed adjacent to heel region 14 may be associated with a fourth thickness T4. Fourth thickness T4 may be smaller than third thickness T3. In some cases, fourth thickness T4 may be larger than second thickness T2 and first thickness T1. In other cases, fourth thickness T4 may be equal to or smaller than second thickness T2, but larger than first thickness T1.

With this arrangement, the thicker portions of central support structure 200 provide stiffness and support to a portion of midfoot region 12 and heel region 14, while the thinner portions of central support structure 200 provide flexibility to forefoot region 10. For example, first thickness T1 of central support structure 200 may be configured to provide flexibility to sole assembly 104 at forefoot region 10, whereas second thickness T2, third thickness T3, and/or fourth thickness T4 may be configured to provide stiffness and support to sole assembly 104 at midfoot region 12 and/or heel region 14. In an exemplary embodiment where third thickness T3 is associated with the largest thickness of central support structure 200, sole assembly 104 may be provided with the greatest amount of stiffness and support at that location.

In various embodiments, the thickness of portions of central support structure 200 may vary from 1 mm to 10 mm. In one embodiment, first thickness T1 may be from 1 mm to 3 mm, second thickness T2 may be from 2 mm to 5 mm, third thickness T3 may be from 5 mm to 10 mm, and fourth thickness may be from 3 mm to 8 mm. In other embodiments, however, the thicknesses may be larger or smaller than the exemplary embodiments described herein.

In one embodiment, central support structure 200 may be further configured with a varying width along the lateral direction. With this arrangement, different amounts of stiffness and flexibility may be provided to different portions of sole assembly 104. In an exemplary embodiment, central support structure 200 may be provided with a wider portion disposed in forefoot region 10 to assist with bending of sole assembly 104 in forefoot region 10. The wider portion of central support structure 200 in forefoot region 10 may provide a springboard-like effect to sole assembly 104 by yielding to bending under applied pressure, but also providing a restoring force to spring sole assembly 104 back into position.

In this embodiment, the width of central support structure 200 may generally increase from first end 202 towards second end 204. For example, a portion of central support structure 200 disposed in forefoot region 10 adjacent to first end 202 may be associated with a first width W1. First width W1 may be larger than the remaining portions of central support structure 200. Moving in the longitudinal direction towards second end 204, a portion of central support structure 200 disposed in midfoot region 12 adjacent to forefoot region 10 may be associated with a second width W2. Second width W2 may be smaller than first width W1. Continuing in the longitudinal direction, a portion of central support structure 200 disposed in midfoot region 12 may be associated with a third width W3. Third width W3 may be smaller than second width W2 and first width W1. In addition, a portion of central support structure 200 disposed adjacent to heel region 14 may be associated with a fourth width W4. Fourth width W4 may be smaller than first width W1, second width W2, and/or third width W3. In this embodiment, central support structure 200 may gradually decrease in width from first width W1 to second width W2 to third width W3 to fourth width W4. In other embodiments, however, decreases in width of central support structure 200 may be abrupt or uneven.

In various embodiments, the width of portions of central support structure 200 may vary from 2 mm to 16 mm. In one embodiment, first width W1 may be from 8 mm to 16 mm, second width W2 may be from 6 mm to 12 mm, third width W3 may be from 4 mm to 10 mm, and fourth width W4 may be from 2 mm to 8 mm. In other embodiments, however, the widths may be larger or smaller than the exemplary embodiments described herein.

Figure 4:
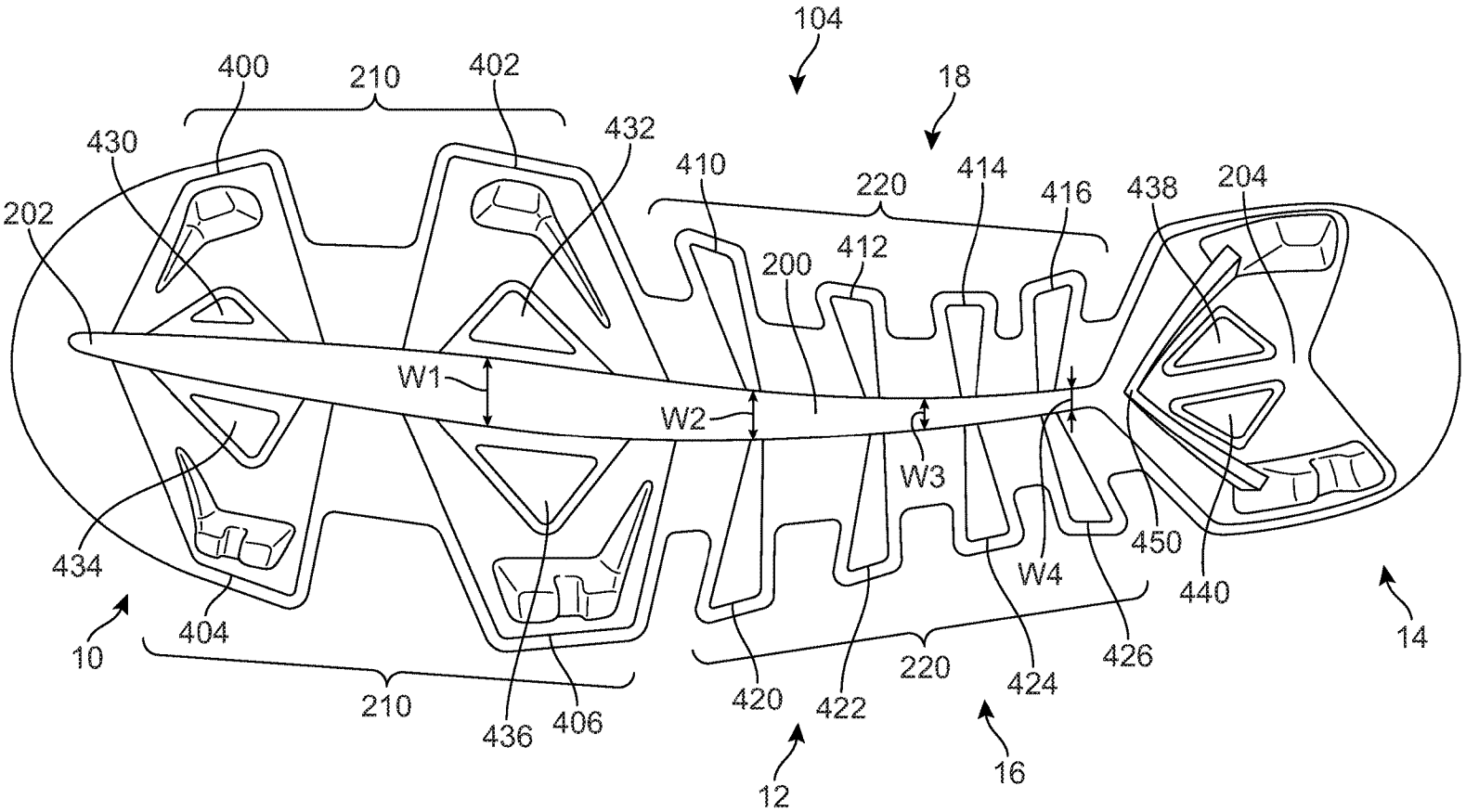
FIG. 4 is a top view of an exemplary embodiment of a sole assembly including a central support structure.

Referring now to FIG. 4, a top view of an exemplary embodiment of sole assembly 104 having central support structure 200 with the varying thickness and varying width described above in reference to FIG. 3 is shown. In this embodiment, sole assembly 104 includes two forefoot wing portions 210 extending in the lateral direction from central support structure 200 on each of medial side 16 and lateral side 18. Forefoot wing portions 210 may include a first forefoot wing 400 disposed on lateral side 18 in forefoot region 10 near first end 202 of central support structure 200 and a second forefoot wing 402 disposed on lateral side in forefoot region 10 adjacent to first forefoot wing 400 and near midfoot region 12. In this embodiment, forefoot wing portions 210 include matching pairs of forefoot wings similarly disposed on medial side 16, including a third forefoot wing 404 and a fourth forefoot wing 406. Third forefoot wing 404 may be disposed on medial side 16 opposite first forefoot wing 400 in forefoot region 10 near first end 202 of central support structure 200. Similarly, fourth forefoot wing 406 may be disposed on medial side 16 opposite second forefoot wing 402 in forefoot region 10 adjacent to third forefoot wing 404 and near midfoot region 12.

In some embodiments, two forefoot wings may be disposed on opposite sides of sole assembly 104 to form a pair of forefoot wing portions 210. In this embodiment, taken together, first forefoot wing 400 and third forefoot wing 404 may form a first pair of forefoot wing portions 210 that are disposed in forefoot region 10 at a front end of sole assembly 104. Similarly, second forefoot wing 402 and fourth forefoot wing 406 may form a second pair of forefoot wing portions 210 that are disposed apart from first forefoot wing 400 and third forefoot wing 404 closer to midfoot region 12 of sole assembly 104. In other embodiments, however, forefoot wings may not be disposed in opposing pairs and may be disposed in unequal numbers on opposing sides of sole assembly 104.

In this embodiment, sole assembly 104 includes two stability rib portions 220 extending in the lateral direction from central support structure 200 on each of medial side 16 and lateral side 18. Stability rib portions 220 may include a first stability rib element 410, a second stability rib element 412, a third stability rib element 414, and a fourth stability rib element 416 disposed along central support structure 200 on lateral side 18 in midfoot region 12. Stability rib portions 220 may further include a fifth stability rib element 420, a sixth stability rib element 422, a seventh stability rib element 424, and an eighth stability rib element 426 disposed along central support structure 200 on medial side 16 in midfoot region 12.

In this embodiment, stability rib portions 220 include matching pairs of stability rib elements similarly disposed on medial side 16 and lateral side 18. First stability rib element 410 may be disposed opposite fifth stability rib element 420, second stability rib element 412 may be disposed opposite sixth stability rib element 422, third stability rib element 414 may be disposed opposite seventh stability rib element 424, and fourth stability rib element 416 may be disposed opposite eighth stability rib element 426. In other embodiments, however, stability rib elements may not be disposed in opposing pairs and may be disposed in unequal numbers on opposing sides of sole assembly 104.

In some embodiments, sole assembly 104 may include additional features configured to increase flexibility of sole assembly 104. In an exemplary embodiment, sole assembly 104 may include one or more cut-out portions that are areas that may be open or substantially free of material. In other embodiments, cut-out portions may be areas that include material that is substantially less rigid than the remaining portions of sole assembly 104. In an exemplary embodiment, the cut-out portions may have a generally triangular shape. However, in different embodiments, the cut-out portions may have any shape, including, but not limited to triangular, square, rectangular, circular, ovoid, and any other regular and irregular geometric and non-geometric shapes.

In this embodiment, sole assembly 104 includes cut-out portions associated with forefoot wing portions 210 disposed in forefoot region 10. First forefoot wing 400 may include a first cut-out portion 430 disposed adjacent to central support structure 200. First cut-out portion 430 may be configured to separate the material connecting first forefoot wing 400 at central support structure 200 into two split ends or legs. With this arrangement, by providing first cut-out portion 430 between central support structure 200 and first forefoot wing 400, the split end or leg attachment may assist first forefoot wing 400 with flexibility and movement relative to central support structure, as will be further described in reference to FIG. 9 below. Similarly, sole assembly 104 may include additional cut-out portions associated with the other forefoot wings, including a second cut-out portion 432 associated with second forefoot wing 402, a third cut-out portion 434 associated with third forefoot wing 404, and/or a fourth cut-out portion 436 associated with fourth forefoot wing 406.

In addition to providing flexibility to sole assembly, cut-out portions may also reduce the weight of sole assembly 104. In some embodiments, sole assembly 104 may include cut-out portions that are substantially free of material to provide a reduction in the weight of sole assembly. In an exemplary embodiment, first cut-out portion 430, second cut-out portion 432, third cut-out portion 434, and/or fourth cut-out portion 436 may provide weight savings to sole assembly 104 in addition to providing flexibility, as described above. In one embodiment, sole assembly 104 may include cut-out portions that do not necessarily increase flexibility of sole assembly 104, but may provide weight savings. In an exemplary embodiment, a fifth cut-out portion 438 may be disposed on lateral side 18 in heel region 14 and a sixth cut-out portion 440 may be disposed on medial side 16 in heel region 14. In this embodiment, fifth cut-out portion 438 and/or sixth cut-out portion 440 may be disposed adjacent to second end 204 of central support structure 200. Heel region 14 of sole assembly 104 may be relatively stiff compared with the remaining portions of sole assembly 104 and fifth cut-out portion 438 and/or sixth cut-out portion 440 may provide weight savings to sole assembly 104 at heel region 14.

In addition, sole assembly 104 may be provided with a rear traction feature 450 disposed in heel region 14 of sole assembly. In this embodiment, rear traction feature 450 may be disposed proximate to fifth cut-out portion 438 and/or sixth cut-out portion 440. Rear traction feature 450, as will be further described with reference to FIG. 14 below, may be an element raised above bottom surface 106 of sole assembly 104 that is configured to provide traction to an article of footwear.

Figure 5:
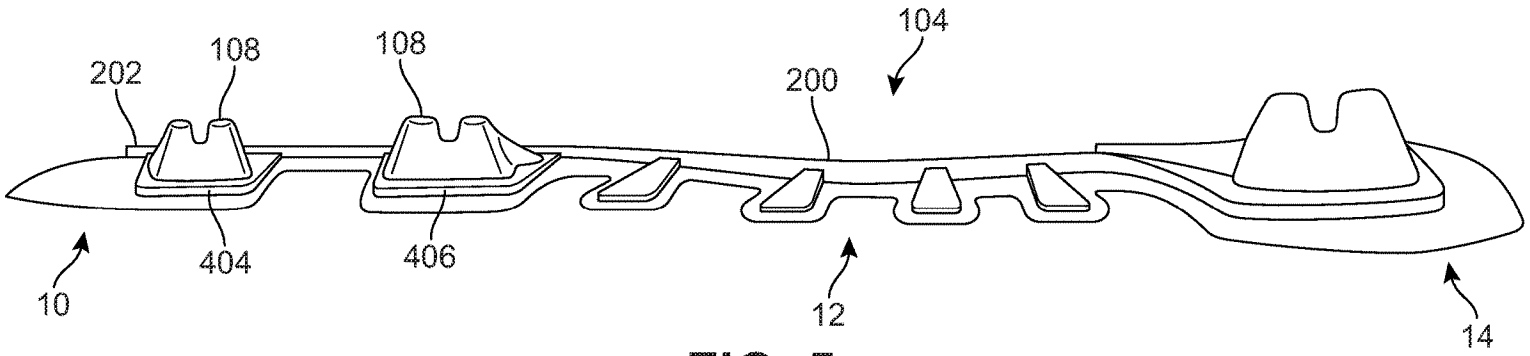
FIG. 5 is a side view of an exemplary embodiment of a sole assembly.
Figure 6:
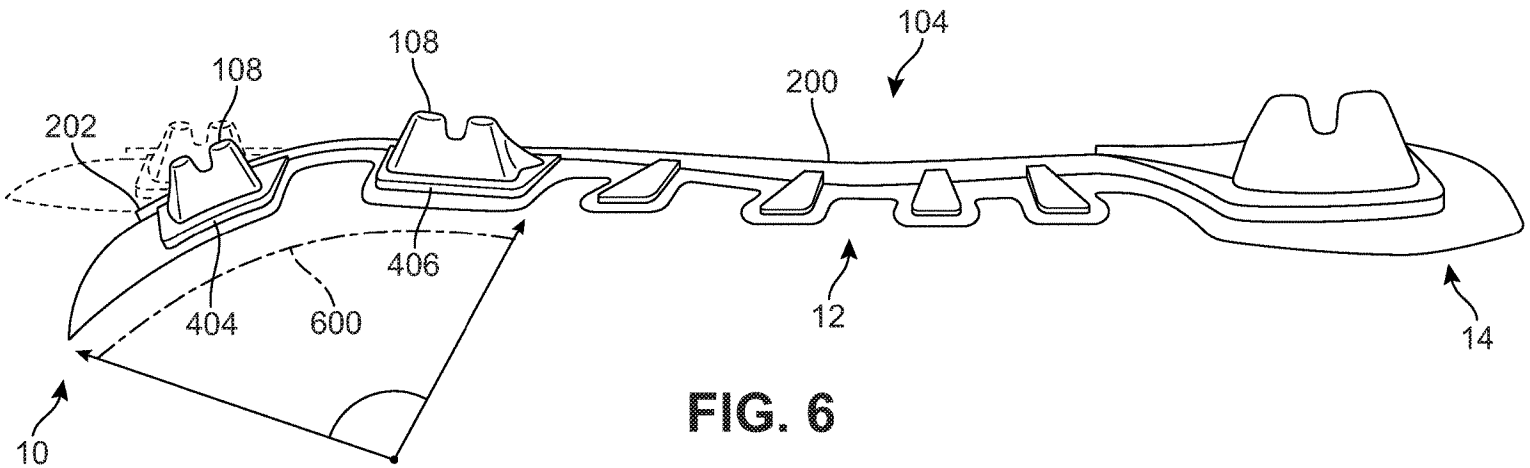
FIG. 6 is a side view of an exemplary embodiment of a sole assembly shown with a gradual bend at a forefoot region.

FIGS. 5 and 6 illustrate the flexibility provided to forefoot region 10 of sole assembly 104 by central support structure 200. As described above, in an exemplary embodiment, central support structure 200 in forefoot region 10 may be configured with first width W1 that is larger than the width of the remaining portion of central support structure 200. With this arrangement, the wider portion of central support structure 200 in forefoot region 10 may provide a springboard-like effect to sole assembly 104 by yielding to bending under applied pressure, but also providing a restoring force to spring sole assembly 104 back into an initial position.

Referring now to FIG. 5, an initial position of sole assembly 104 is shown. In this view, the entirety of sole assembly 104 is in a substantially straight initial position along the vertical direction. This initial position may correspond to an article of footwear resting flat against a ground surface while being worn. When a wearer of the article of footwear moves his or her foot from this initial position to taking a step by bending the foot, sole assembly 104 will undergo a bending located at forefoot region 10.

Referring now to FIG. 6, a bent position of sole assembly 104 is shown. In this view, sole assembly 104 is bent in the vertical direction at forefoot region 10 relative to the remaining portion of sole assembly 104. As noted above, this bent position may correspond to a wearer of an article of footwear moving his or her foot when taking a step or raising up on the ball of the foot. In an exemplary embodiment, the configuration of central support structure 200 with a wide, thin portion disposed in forefoot region 10, corresponding to first width W1 and first thickness T1, as compared with the remaining portion of central support structure 200, may allow sole assembly 104 to undergo a gentle or gradual bending at forefoot region 10. In contrast, a conventional sole assembly tends to bend like a hinge when bent by the movement of a wearer's foot. That is, the conventional sole assembly tends to have a sharp, flat bend localized at the point where the wearer's foot is bending.

In an exemplary embodiment, forefoot region 10 of sole assembly 104 may be associated with a curvature 600 in the bent position. Curvature 600 is a gradual bending at forefoot region 10, rather than a hinge-like bend associated with a conventional sole assembly. In one embodiment, curvature 600 may be associated with a radius of curvature that distributes pressure of the bending of sole assembly 104 away from a single localized point and over forefoot region 10 of sole assembly 104. In addition, this arrangement of central support structure 200 in forefoot region 10 may provide a springboard-like effect to sole assembly 104 by yielding to bending under applied pressure, and also providing a restoring force to spring sole assembly 104 back into the initial position of FIG. 5 when pressure is removed from sole assembly 104. With this arrangement, an article of footwear with sole assembly 104 may provide a boost or assistance to a wearer when running.

Figure 7:
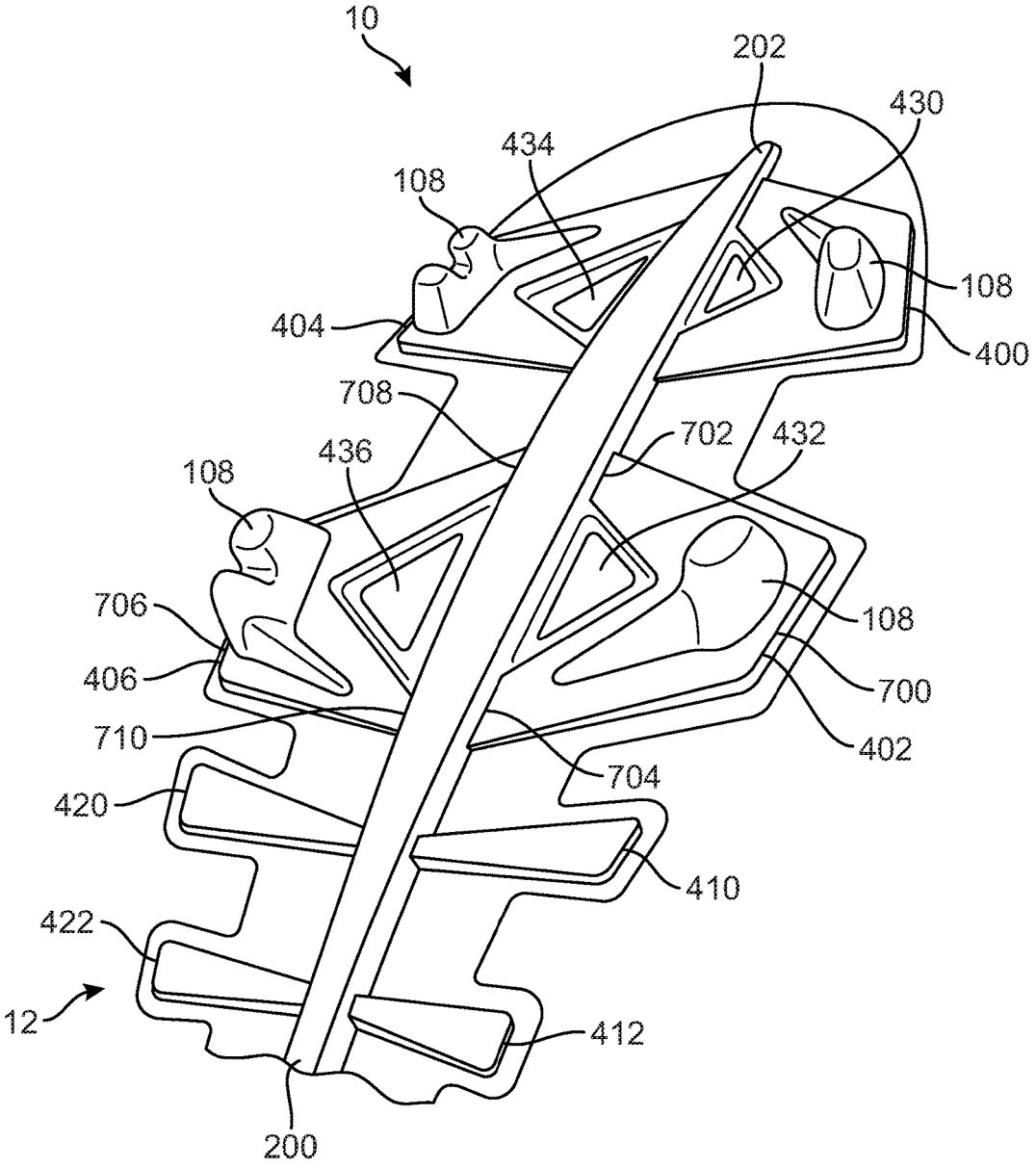
FIG. 7 is an enlarged view of a forefoot region of an exemplary embodiment of a sole assembly.
Figure 8:
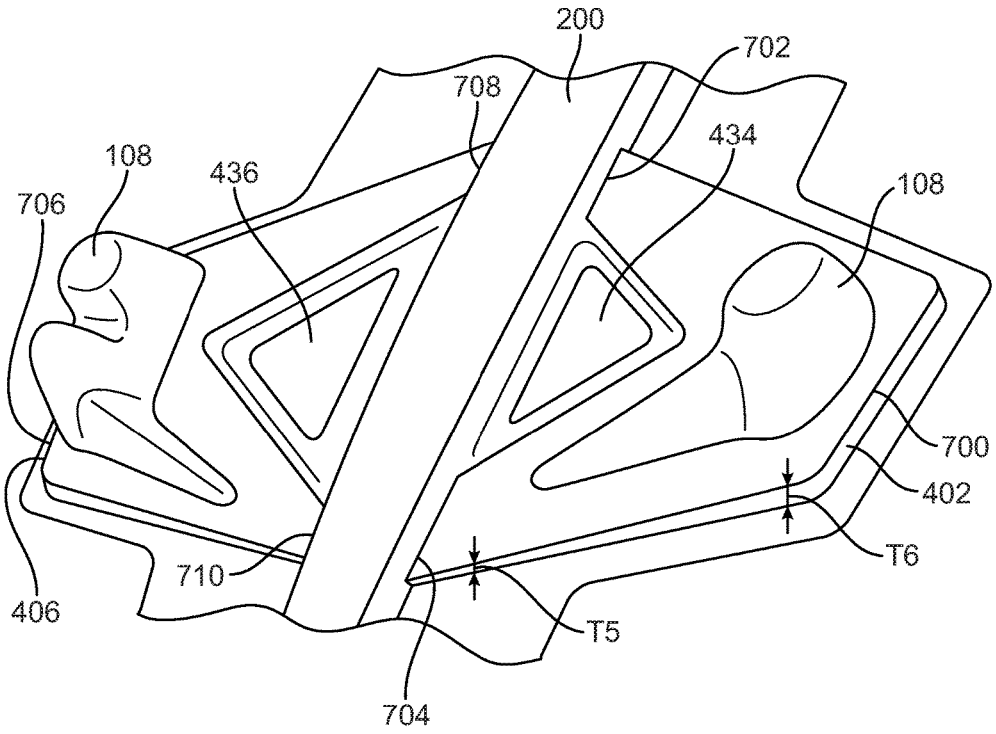
FIG. 8 is an enlarged view of forefoot wing portions associated with an exemplary embodiment of a sole assembly.
Figure 9:
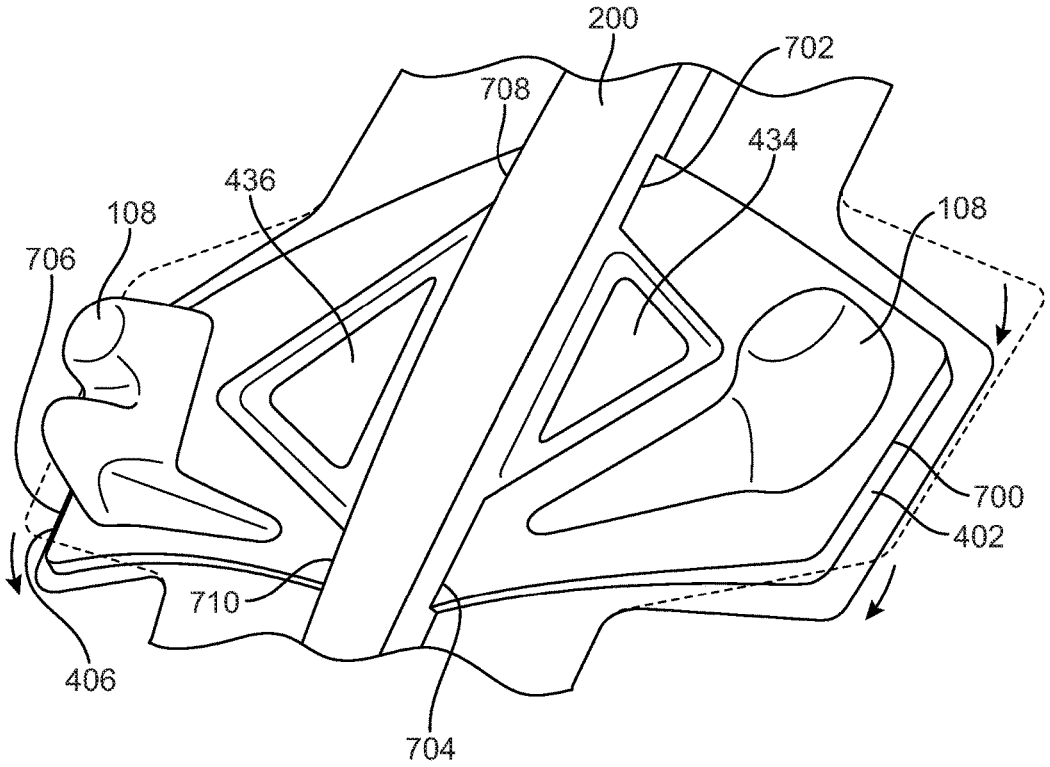
FIG. 9 is a schematic view of the forefoot wing portions of FIG. 8 being flexed.

FIGS. 7-9 illustrate forefoot region 10 of an exemplary embodiment of sole assembly 104. In particular, FIGS. 7-9 show the configuration of forefoot wing portions 210 of sole assembly 104 to provide flexibility at forefoot region 10. Referring now to FIG. 7, an enlarged view of forefoot region 10 of an exemplary embodiment of sole assembly 104 is illustrated. As described above, in some embodiments, sole assembly 104 may include one or more forefoot wing portions 210, including first forefoot wing 400, second forefoot wing 402, third forefoot wing 404, and/or fourth forefoot wing 406 extending away from central support structure 200 in the lateral direction.

In some embodiments, cut-out portions may be disposed between forefoot wing portions 210 and central support structure 200, as described above. In an exemplary embodiment, first cut-out portion 430 is associated with first forefoot wing 400, second cut-out portion 432 is associated with second forefoot wing 402, third cut-out portion 434 is associated with third forefoot wing 404, and/or fourth cut-out portion 436 is associated with fourth forefoot wing 406. As noted above, cut-out portions may separate the material connecting the forefoot wing portions at central support structure 200 into two split ends or legs.

In this embodiment, second forefoot wing 402 may be associated with a peripheral edge 700 disposed away from central support structure 200. Second cut-out portion 432 may separate second forefoot wing 402 into two legs attached to central support structure 200 at a first attachment edge 702 and a second attachment edge 704. In this embodiment, first attachment edge 702 and second attachment edge 704 are separated from one another by second cut-out portion 432. Fourth forefoot wing 406 disposed opposite second forefoot wing 402 may be similarly arranged. In this embodiment, fourth forefoot wing 406 is associated with a peripheral edge 706 disposed away from central support structure 200. Fourth cut-out portion 436 may separate fourth forefoot wing 406 into two legs attached to central support structure 200 at a first attachment edge 708 and a second attachment edge 710. In this embodiment, first attachment edge 708 and second attachment edge 710 are separated from one another by fourth cut-out portion 434. In addition, the other forefoot wing portions, including first forefoot wing 400 and/or second forefoot wing 402 may be similarly arranged with first cut-out portion 430 and/or third cut-out portion 434.

In some embodiments, the thickness of forefoot wing portions may be varied along the lateral direction extending out from central support structure 200. In an exemplary embodiment, forefoot wing portions may be associated with a small thickness proximate central support structure 200 and may increase in thickness extending away from central support structure 200 in the lateral direction. With this arrangement, forefoot wing portions may be configured to flex in the vertical direction. Referring now to FIG. 8, an enlarged view of second forefoot wing 402 and fourth forefoot wing 404 associated with an exemplary embodiment of sole assembly 104 are illustrated. It should be understood that the features described could be similarly applied to first forefoot wing 400 and/or third forefoot wing 404.

As shown in FIG. 8, second forefoot wing 402 may be associated with a smaller thickness proximate to central support structure 200 and increasing to a larger thickness away from central support structure 200. In this embodiment, second forefoot wing 402 may be associated with a fifth thickness T5 at a portion of second forefoot wing 402 disposed proximate to central support structure 200 near second attachment edge 704 and/or first attachment edge 702. Second forefoot wing 402 may increase in thickness extending away from central support structure 200 in the lateral direction. In this embodiment, a portion of second forefoot wing 402 disposed away from central support structure 200 near peripheral edge 700 may be associated with a sixth thickness T6. In an exemplary embodiment, sixth thickness T6 is larger than fifth thickness T5. In this embodiment, fourth forefoot wing 406 may be similarly configured with fifth thickness T5 disposed near second attachment edge 710 and/or first attachment edge 708 and sixth thickness T6 disposed near peripheral edge 706.

In various embodiments, the thickness of forefoot wing portions may vary from 1 mm to 6 mm. In one embodiment, fifth thickness T5 may be from 1 mm to 3 mm and sixth thickness may be from 3 mm to 6 mm. In other embodiments, however, the thicknesses may be larger or smaller than the exemplary embodiments described herein.

As shown in FIG. 9, with this arrangement, second forefoot wing 402 and/or fourth forefoot wing 404 may be configured to bend or pivot at first attachment edge 702 and second attachment edge 704 and/or first attachment edge 708 and second attachment edge 710 to allow movement or flexing of forefoot wing portions in the vertical direction relative to the remaining portion of sole assembly 104.

In addition, in embodiments where sole assembly 104 includes traction elements 108, traction elements 108 may be disposed adjacent to peripheral edge 700 of second forefoot wing 402 and/or peripheral edge 706 of fourth forefoot wing 406. With this arrangement, the thickness of the forefoot wing portions disposed away from central support structure 200 may be configured to alleviate pressure from the interaction of traction elements 108 with a ground surface on the foot of a wearer by dispersing pressure from traction elements 108 over second forefoot wing 402 and/or fourth forefoot wing 404.

Figure 10:
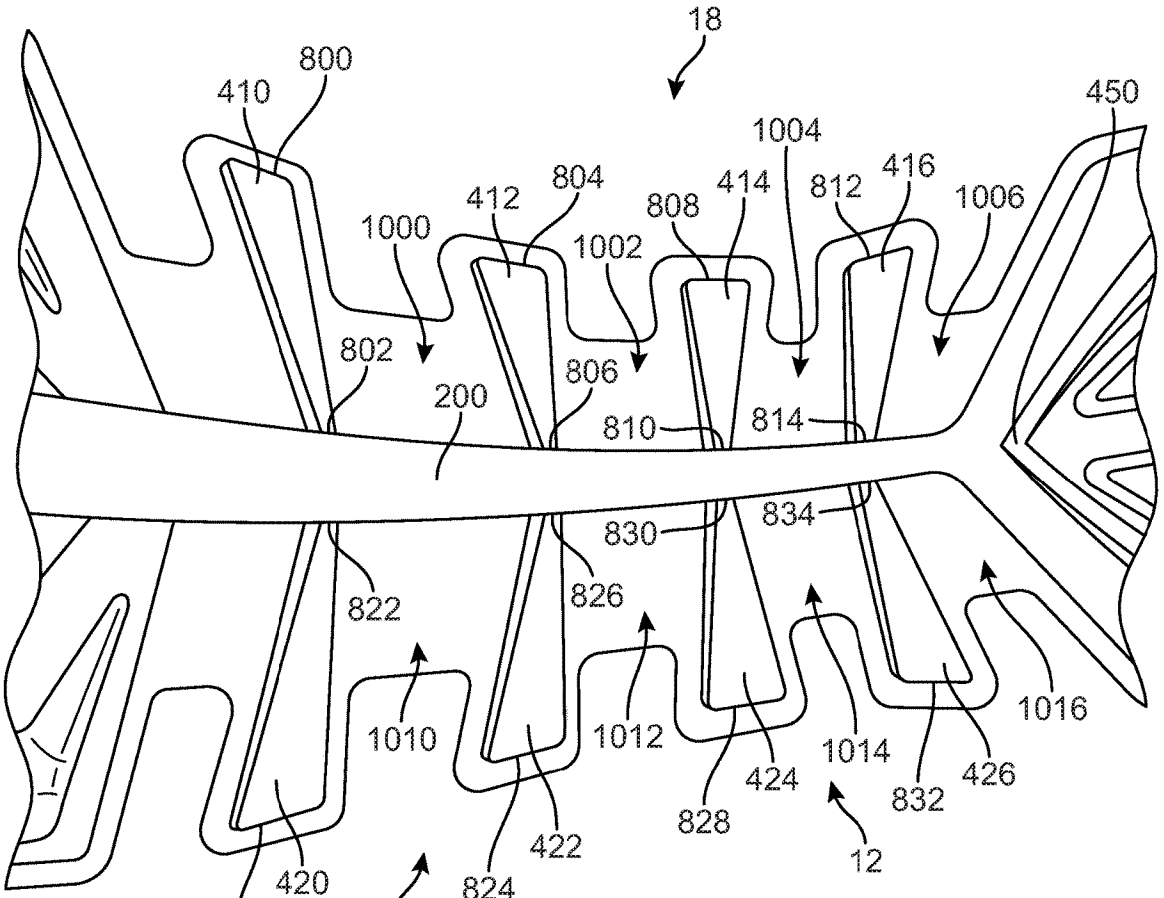
FIG. 10 is an enlarged view of a midfoot region of an exemplary embodiment of a sole assembly.
Figure 11:
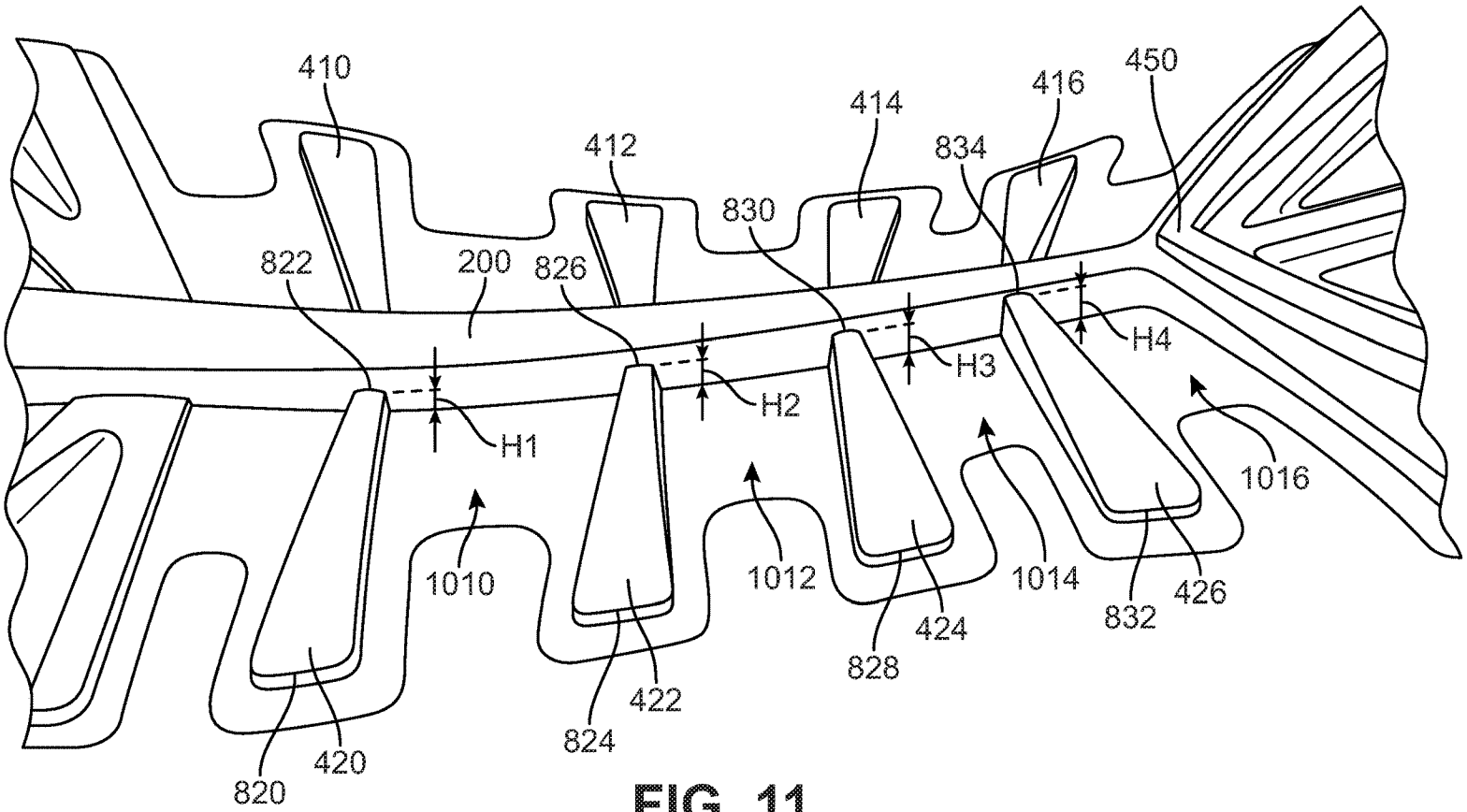
FIG. 11 is an enlarged side view of a midfoot region of an exemplary embodiment of a sole assembly including stability rib elements.
Figure 12:
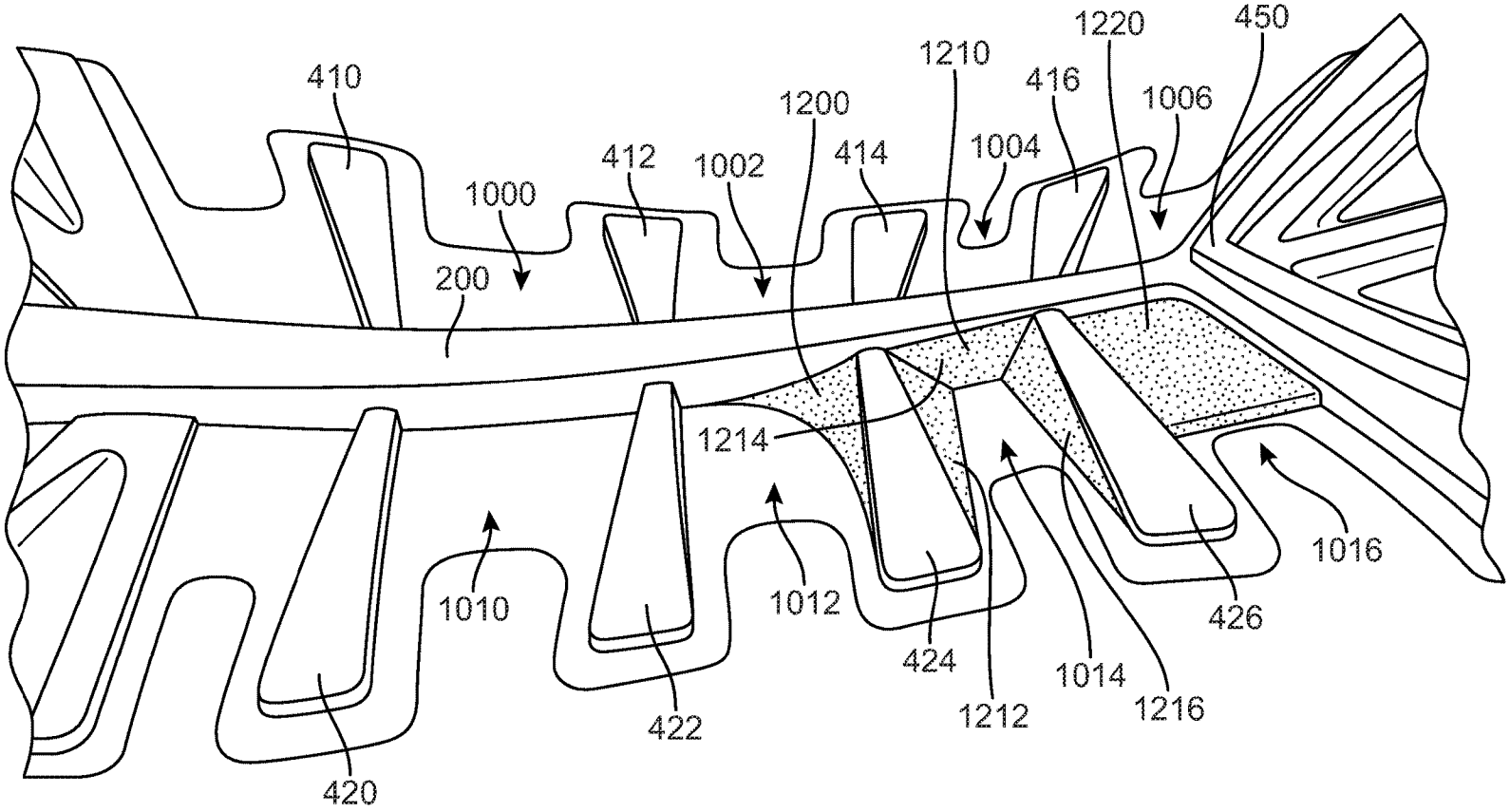
FIG. 12 is an exemplary embodiment of various support features associated with stability rib elements.

FIGS. 10-12 illustrate midfoot region 12 of an exemplary embodiment of sole assembly 104. In particular, FIGS. 10-12 show the configuration of stability rib portions 220 of sole assembly 104 to provide stiffness and support to midfoot region 12. In this embodiment, sole assembly 104 includes eight individual stability rib elements disposed in opposing pairs on each of medial side 16 and lateral side 18, including first stability rib element 410, second stability rib element 412, third stability rib element 414, and fourth stability rib element 416 disposed along central support structure 200 on lateral side 18 and fifth stability rib element 420, sixth stability rib element 422, seventh stability rib element 424, and an eighth stability rib element 426 disposed along central support structure 200 on medial side 16, as described above.

In an exemplary embodiment, individual stability rib elements are formed integrally with central support structure 200 and extend away from central support structure in approximately the lateral direction. Referring now to FIG. 10, in this embodiment, first stability rib element 410 extends away from central support structure 200 in the lateral direction from a proximal end 802 to a distal end 800. In one embodiment, first stability rib element 410 may have a generally elongated trapezoidal shape such that proximal end 802 has a smaller width than distal end 800. On medial side 16, fifth stability rib element 420 may extend away from central support structure 200 from a proximal end 822 to a distal end 820. In this embodiment, fifth stability rib element 420 may have a similar shape as first stability rib element 410, with proximal end 822 having a smaller width than distal end 820. In addition, first stability rib 410 and fifth stability rib element 420 may be disposed in midfoot region 12 adjacent to forefoot region 10. In some embodiments, first stability rib 410 and/or fifth stability rib element 420 may be angled from the lateral direction towards forefoot region 10.

Continuing in the longitudinal direction along central support structure 200 towards second end 204, additional stability rib elements may be disposed in opposing pairs with substantially similar shapes and configurations as first stability rib 410 and/or fifth stability rib element 420. In this embodiment, midfoot region 12 of sole assembly 104 further includes second stability rib element 412 extending away from central support structure 200 in the lateral direction on lateral side 18 from a proximal end 806 to a distal end 804 and sixth stability rib element 422 extending away from central support structure 200 in the lateral direction on medial side 16 from a proximal end 826 to a distal end 824. Second stability rib element 412 and/or sixth stability rib element 422 may be disposed adjacent to first stability rib 410 and/or fifth stability rib element 420 in a direction towards heel region 14. Similarly, midfoot region 12 of sole assembly 104 further includes third stability rib element 414 extending away from central support structure 200 in the lateral direction on lateral side 18 from a proximal end 810 to a distal end 808 and seventh stability rib element 424 extending away from central support structure 200 in the lateral direction on medial side 16 from a proximal end 830 to a distal end 828. Third stability rib element 414 and/or seventh stability rib element 424 may be disposed adjacent to second stability rib element 412 and/or sixth stability rib element 422 in a direction towards heel region 14.

In an exemplary embodiment, midfoot region 12 of sole assembly may include fourth stability rib element 416 extending away from central support structure 200 in the lateral direction on lateral side 18 from a proximal end 814 to a distal end 812 and eighth stability rib element 426 extending away from central support structure 200 in the lateral direction on medial side 16 from a proximal end 834 to a distal end 832. Fourth stability rib element 416 and/or eighth stability rib element 426 may be disposed adjacent to heel region 14 near rear traction feature 450. In some embodiments, fourth stability rib element 416 and/or eighth stability rib element 426 may be angled from the lateral direction towards heel region 14.

Individual stability rib elements disposed on medial side 16 and/or lateral side 18 may be separated or spaced apart from one another by a distance. In some embodiments, the separation between adjacent stability rib elements may form a gap defined by the facing sides of two adjacent stability rib elements or other portions of sole assembly 104. In an exemplary embodiment, sole assembly 104 may be configured with a plurality of gaps in midfoot region 12 between stability rib elements to reduce the amount of torsional stiffness to sole assembly 104 when twisting or rotating around the longitudinal direction.

In this embodiment, the plurality of gaps disposed on lateral side 18 of sole assembly 104 includes a first gap 1000 disposed between first stability rib element 410 and second stability rib element 412, a second gap 1002 disposed between second stability rib element 412 and third stability rib element 414, a third gap 1004 disposed between third stability rib element 414 and fourth stability rib element 416, and a fourth gap 1006 disposed between fourth stability rib element 416 and rear traction feature 450. Similarly, the plurality of gaps disposed on medial side 16 of sole assembly 104 includes a fifth gap 1010 disposed between fifth stability rib element 420 and sixth stability rib element 422, a sixth gap 1012 disposed between sixth stability rib element 422 and seventh stability rib element 424, a seventh gap 1014 disposed between seventh stability rib element 424 and eighth stability rib element 426, and an eighth gap 1016 disposed between eighth stability rib element 426 and rear traction feature 450.

In some embodiments, the amount of stiffness and support provided to midfoot region 12 of sole assembly 104 may be varied based on the placement of individual stability rib elements along central support structure 200. In an exemplary embodiment, stability rib elements may be disposed along central support structure 200 in a manner to increase the amount of stiffness in a direction towards heel region 14. With this arrangement, midfoot region 12 of sole assembly 104 may have a smaller amount of stiffness adjacent to forefoot region 10 and a larger amount of stiffness adjacent to heel region 14.

In one embodiment, the stiffness may be increased by increasing the height of individual stability rib elements along the vertical direction of central support structure 200. As shown in FIG. 11, individual stability rib elements may be disposed at increasingly larger heights along the side of central support structure 200 in a direction towards heel region 14. In this embodiment, fifth stability rib element 420 may be disposed on the side of central support structure 200 at a first height H1 from bottom surface 106 of sole assembly 104. In this embodiment, fifth stability rib element 420 may be associated with a thickness at proximal end 822 that corresponds with first height H1 and tapers to a reduced thickness at distal end 820.

Sixth stability rib element 422 may be disposed on the side of central support structure 200 at a second height H2 from bottom surface 106 of sole assembly 104. In this embodiment, sixth stability rib element 422 may be associated with a thickness at proximal end 826 that corresponds with second height H2 and tapers to a reduced thickness at distal end 824. In some embodiments, second height H2 may be larger than first height H1. In other embodiments, however, for example where stiffness is to be the same or reduced, second height H2 may be equal to or smaller than first height H1.

Seventh stability rib element 424 may be disposed on the side of central support structure 200 at a third height H3 from bottom surface 106 of sole assembly 104. In this embodiment, seventh stability rib element 424 may be associated with a thickness at proximal end 830 that corresponds with third height H3 and tapers to a reduced thickness at distal end 828. In some embodiments, third height H3 may be larger than second height H2 and first height H1. In other embodiments, for example where stiffness is to be the same or reduced, third height H3 may be equal to or smaller than second height H2 and/or first height H1.

Eighth stability rib element 426 may be disposed on the side of central support structure 200 at a fourth height H4 from bottom surface 106 of sole assembly 104. In this embodiment, eighth stability rib element 426 may be associated with a thickness at proximal end 834 that corresponds with fourth height H4 and tapers to a reduced thickness at distal end 832. In some embodiments, fourth height H4 may be larger than each of third height H3, second height H2 and/or first height H1 In other embodiments, for example where stiffness is to be the same or reduced, fourth height H4 may be equal to or smaller than any of third height H3, second height H2 and/or first height H1.

In various embodiments, the heights of stability rib portions on central support structure 200 may vary from 2 mm to 12 mm above bottom surface 106. In one embodiment, first height H1 may be from 2 mm to 4 mm, second height H2 may be from 4 mm to 8 mm, third height H3 may be from 5 mm to 10 mm, and fourth height H4 may be from 5 mm to 10 mm. In other embodiments, however, the heights may be larger or smaller than the exemplary embodiments described herein.

It should be understood that the individual stability rib elements disposed on lateral side 18 may have a substantially similar arrangement, including heights and thicknesses, as the stability rib elements disposed on medial side 16 that have been described above in reference to FIG. 11. With this arrangement, by varying the heights and thickness of the stability rib elements at the proximal end attaching each stability rib element to central support structure 200, the stiffness of sole assembly 104 may be varied along the longitudinal direction to provide more or less support or flexibility to sole assembly 104.

In some embodiments, the stiffness of midfoot region 12 of sole assembly 104 may further be varied by selective placement of additional filler material in one or more gaps between stability rib elements. Referring now to FIG. 12, different exemplary embodiments of reinforcing elements disposed in gaps between stability rib elements are illustrated. In different embodiments, stiffening elements may be configured as additional material disposed in the plurality of gaps and the stiffness of the reinforcing element may be varied by the use of more or less rigid materials for the reinforcing element, geometry of the placement of the reinforcing element, amount of material used for the reinforcing element, or a combination of one or more of these methods.

Figure 13:
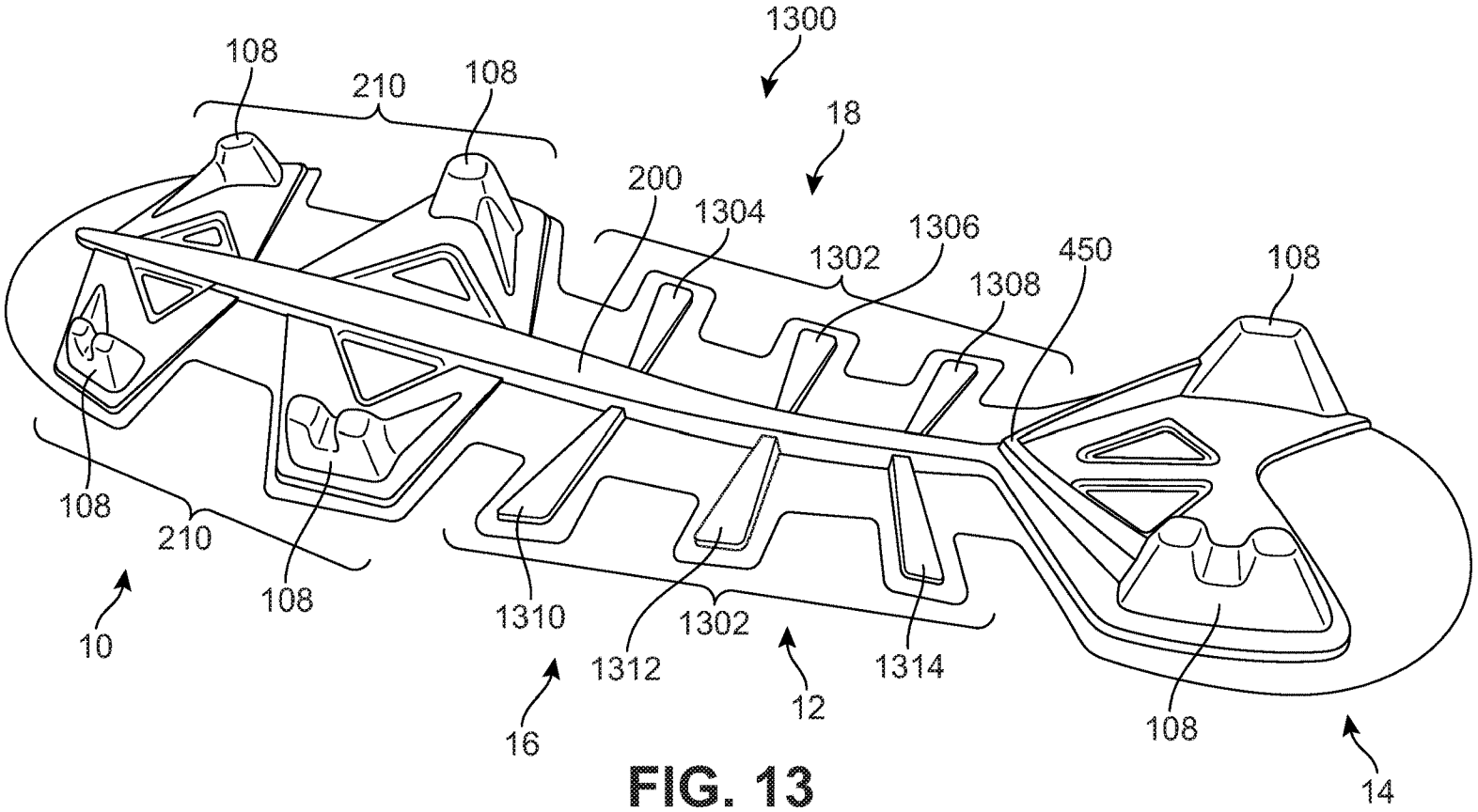
FIG. 13 is an alternate embodiment of a sole assembly including a central support structure with stability rib elements.

In one embodiment, a corner reinforcing element 1200 may be configured to reinforce and provide additional stiffness proximate to a corner where a stability rib element joins with central support structure 200. In this embodiment, corner reinforcing element 1200 is disposed in sixth gap 1012 between sixth stability rib element 422 and seventh stability rib element 424 at the corner of the intersection of seventh stability rib element 424 with central support structure 200. As shown in FIG. 13, corner reinforcing element 1200 may include an amount of material that reaches approximately the same height as seventh stability rib element 424 at the corner of sixth gap 1012 and tapers off in either direction along central support structure 200 and seventh stability rib element 424. With this arrangement, increased stiffness may be provided to sole assembly 104. In particular, corner reinforcing element 1200 may reinforce or provide additional stiffness close to the center of sole assembly 104 to assist with torsional stiffness when twisting about the longitudinal direction.

In another embodiment, a beveled reinforcing element 1210 may be configured to reinforce and provide additional stiffness proximate three sides of a gap between adjacent stability rib elements, including along a portion of central support structure 200. In this embodiment, beveled reinforcing element 1210 is disposed in seventh gap 1014 between seventh stability rib element 424 and eighth stability rib element 426. In some embodiments, beveled reinforcing element 1210 may include a first beveled portion 1212 disposed along one side of seventh stability rib element 424 facing towards seventh gap 1014, a second beveled portion 1214 disposed along a portion of central support structure 200 disposed within seventh gap 1014, and a third beveled portion 1216 disposed along one side of eighth stability rib element 426 facing towards seventh gap 1014. In one embodiment, each of first beveled portion 1212, second beveled portion 1214, and third beveled portion 1216 may include an amount of material that reaches approximately the same height as the element on which it is disposed and may taper off towards the middle seventh gap 1014. In some cases, the central portion of seventh gap 1014 may be substantially free of beveled reinforcing element 1210. In other cases, however, beveled reinforcing element 1210 may fill the majority or entirety of seventh gap 1014. With this arrangement, additional stiffness may be provided to sole assembly 104.

In still other embodiments, a filled reinforcing element 1220 may be configured to reinforce and provide additional stiffness throughout the majority of a gap, including along a portion of central support structure 200. In this embodiment, filled reinforcing element 1220 is disposed in eighth gap 1016 between eighth stability rib element 426 and rear traction feature 450. As shown in FIG. 13, filled reinforcing element 1220 may be an amount of filled in material within eighth gap 1016 that extends from one side of eighth stability rib element 426 and rear traction feature 450 disposed at heel region 14. In other embodiments where filled reinforcing element 1220 is disposed between adjacent stability rib elements, filled reinforcing element 1220 may extend between facing sides of the adjacent stability rib elements. In addition, in this embodiment, filled reinforcing element 1220 includes an amount of filled in material that does not reach to the same height as the surrounding portions. However, in other embodiments, filled reinforcing element 1220 may include more or less material to provide greater or lesser amounts of additional stiffness to sole assembly 104.

It should be understood that any of the embodiments of reinforcing elements described above, including corner reinforcing element 1200, beveled reinforcing element 1210, and/or filled reinforcing element 1220, may be disposed at any of the gaps disposed on sole assembly 104, on lateral side 18 and/or medial side 16 to provide additional stiffness at a desired location on sole assembly 104. In addition, in some embodiments, reinforcing elements are optional and may be omitted.

In the previous embodiments, an exemplary embodiment of sole assembly 104 having four individual stability rib elements on each of medial side 16 and lateral side 18 has been described. In other embodiments, however, a larger or smaller number of stability rib elements may be included on a sole assembly. FIG. 13 illustrates an alternate embodiment of a sole assembly 1300 having a smaller number of stability rib elements. In some embodiments, sole assembly 1300 may include one or more components that are substantially similar to sole assembly 104, described above. In this embodiment, sole assembly 1300 includes forefoot wing portions 210, traction elements 108, rear traction feature 450, and central support structure 200 that are configured in a substantially similar manner as described above. In this embodiment, however, sole assembly 1300 includes stability rib portions 1302 that include three individual stability rib elements on each of lateral side 18 and medial side 16.

As shown in FIG. 13, stability rib portion 1302 disposed on lateral side 18 includes a first stability rib element 1302, a second stability rib element 1304, and a third stability rib element 1306. Similarly, stability rib portion 1302 disposed on medial side includes a fourth stability rib element 1310, a fifth stability rib element 1312, and a sixth stability rib element 1314. Each of first stability rib element 1302, second stability rib element 1304, third stability rib element 1306, fourth stability rib element 1310, fifth stability rib element 1312, and/or sixth stability rib element 1314 may configured with substantially similar features as any of the stability rib elements described above in reference to sole assembly 104. With this arrangement, sole assembly 1300 having a smaller number of stability rib elements may be configured to provide a smaller amount of stiffness and a larger amount of flexibility to a sole assembly for an article of footwear than sole assembly 104, described above.

Figure 14:
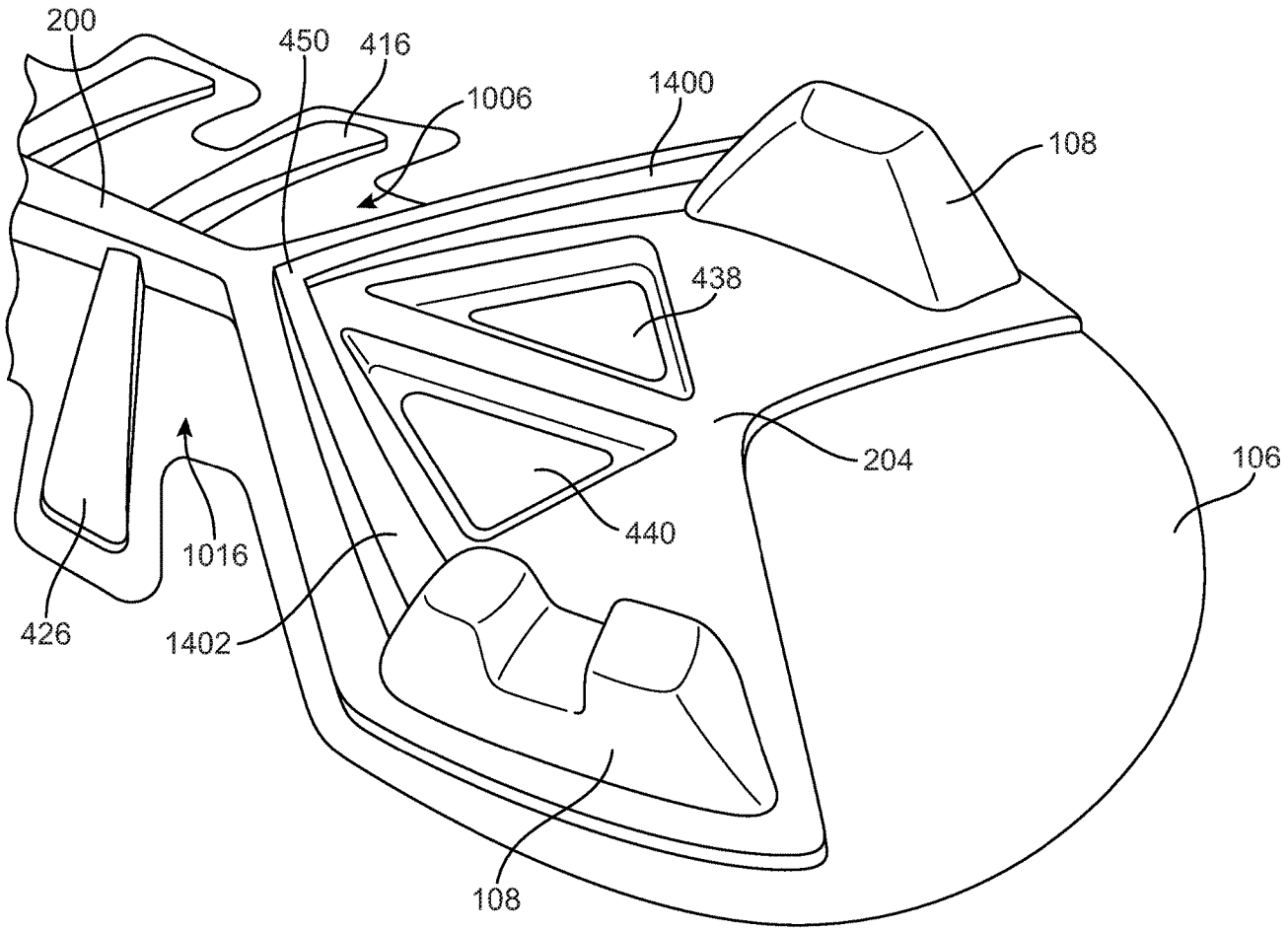
FIG. 14 is an enlarged view of an exemplary embodiment of a heel region of a sole assembly.
Figure 15:
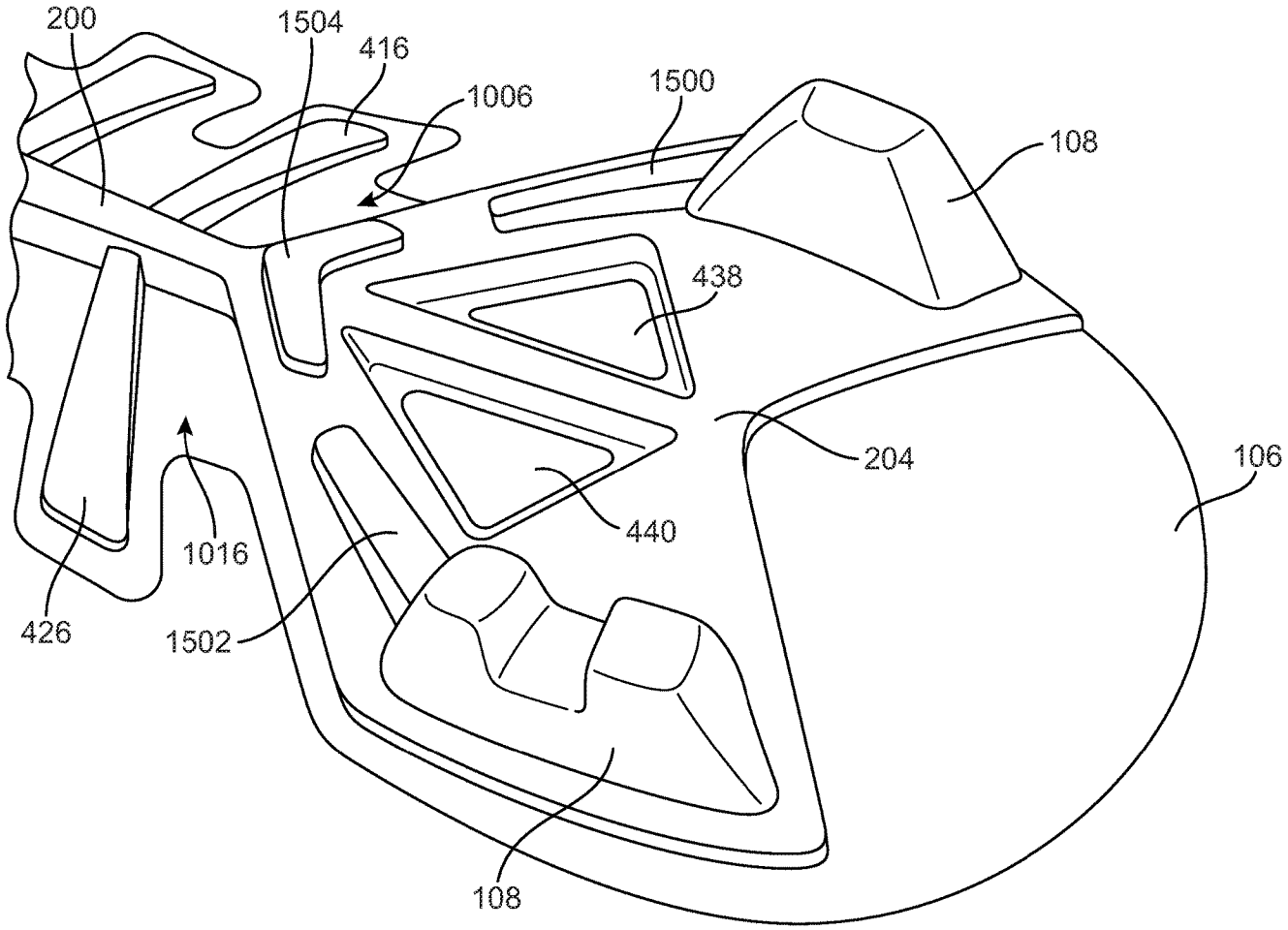
FIG. 15 is an enlarged view of an alternate embodiment of a heel region of a sole assembly.

FIGS. 14 and 15 illustrate two exemplary embodiments of a rear traction feature that may be disposed in heel region 14 of sole assembly 104 to provide assistance with traction on a ground surface. It should be understood that the exemplary rear traction features shown in FIGS. 14 and 15 are optional to provide additional traction to an article and may be omitted in some embodiments.

Referring now to FIG. 14, an enlarged view of rear traction feature 450 is illustrated. In this embodiment, rear traction feature 450 may be disposed with a point located at approximately a centerline of sole assembly 104 at heel region 14 adjacent to fourth gap 1016 towards the front and adjacent to second end 204 of central support structure 200 towards the back periphery of heel region 14. In an exemplary embodiment, the point of rear traction feature 450 is aligned facing towards forefoot region 10 of sole assembly 104.

In this embodiment, rear traction feature 450 is formed by the intersection of two elongate support members, described above, extending away from traction elements 108 disposed in heel region 14. In this embodiment, the elongate support members are raised above bottom surface 106 of sole assembly 104 to provide rear traction feature 450. In addition, in some embodiments, the elongate support members may taper from the side of traction elements 108 to the point forming rear traction feature 450.

In other embodiments, a rear traction feature may be provided as a separate cleat or stud. Referring now to FIG. 15, an alternate embodiment of a central rear cleat 1504 is illustrated. In this embodiment, central rear cleat 1504 may be raised above bottom surface 106 of sole assembly 104 at substantially the same location as rear traction feature 450, described above. However, in this embodiment, elongate support members extending away from traction elements 108 disposed in heel region 14, including first elongate support member 1500 on lateral side 18 and second elongate support member 1502 on medial side 16, do not intersect. Instead, in this embodiment, central rear cleat 1504 is provided as a separate element having a chevron or v-like shape with a point facing towards forefoot region 10 of sole assembly 104.

Figure 16:
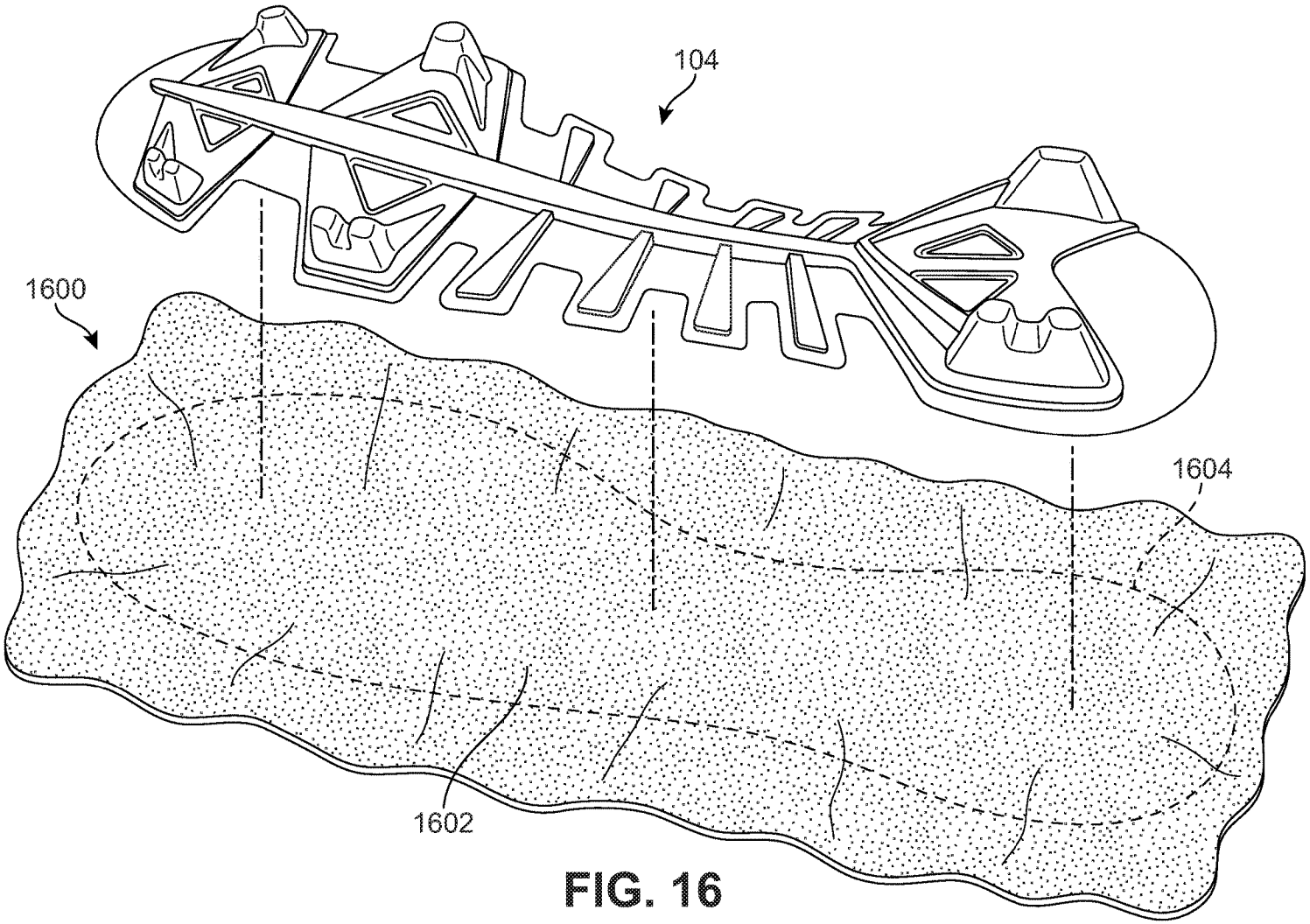
FIG. 16 is a schematic view of an exemplary embodiment of providing a sole assembly with a carrier element.
Figure 17:
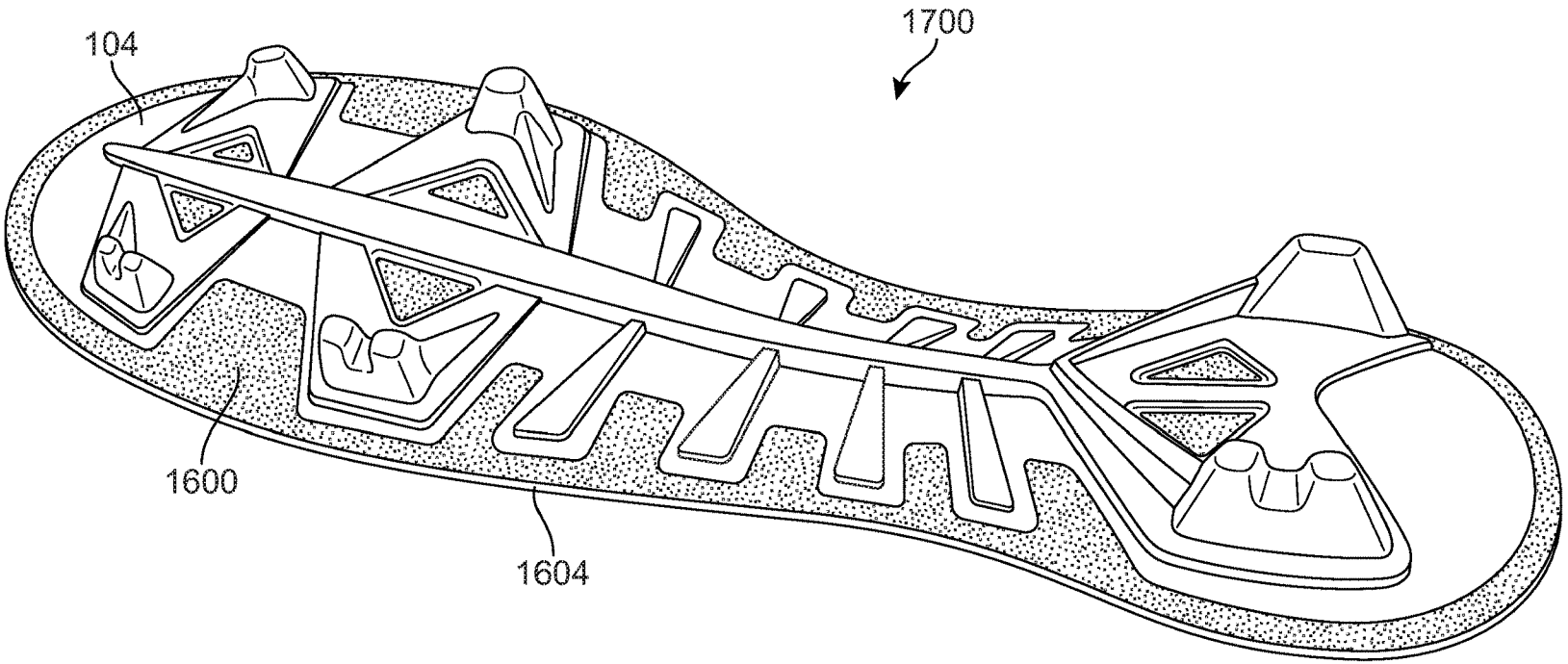
FIG. 17 is an exemplary embodiment of a sole assembly having a carrier element.
Figure 18:
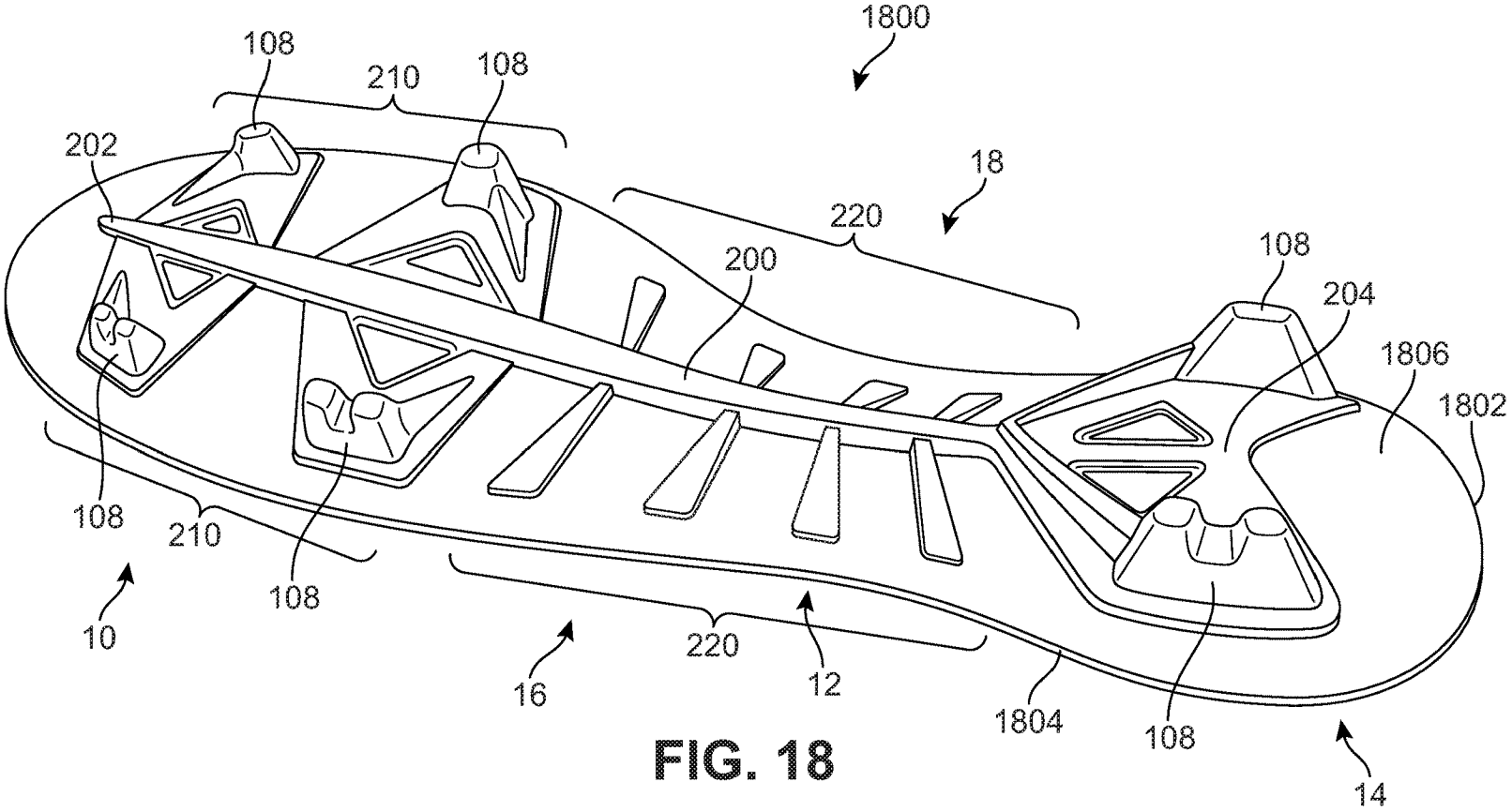
FIG. 18 is an alternate embodiment of a sole assembly with an integrally molded carrier element.

In some embodiments, a sole assembly may be provided with additional components that are configured to facilitate joining the sole assembly with an upper. In an exemplary embodiment a sole assembly may be associated with a carrier element that is configured to provide a larger surface area for attaching the sole assembly to the bottom of the upper or to a midsole or strobe element. FIGS. 16 through 18 illustrate embodiments for a sole assembly having a carrier element.

Referring now to FIG. 16, in some embodiments a sole assembly, including sole assembly 104, described above, may be associated with a carrier element. In this embodiment, the carrier element may be a film or film-like sheet of material 1600. In one embodiment, material 1600 may be substantially flexible and may be configured to easily conform to various shapes. In other embodiments, however, material 1600 may be semi-rigid or rigid, including, but not limited to: a polymer or carbon-fiber plate of various levels of rigidity.

In this embodiment, sole assembly 104 may be disposed onto a top surface 1602 of material 1600. Sole assembly 104 may be attached or joined to top surface 1602 of material 1600 using any known method of attachment, including, but not limited to: bonding or adhering using adhesives. In an exemplary embodiment, material 1600 may be configured to have a shape corresponding to a shape of a bottom of an upper, shown as perimeter 1604. In some cases, material 1600 may be cut or stamped along perimeter 1604 after sole assembly 104 has been joined or attached to top surface 1602 of material 1600. In other cases, material 1600 may be cut or stamped along perimeter 1604 prior to joining or attaching sole assembly 104 to top surface 1602 of material 1600.

In an exemplary embodiment, perimeter 1604 may be configured to be larger than an outer perimeter of sole assembly 104. With this configuration, the portion of material 1600 extending beyond the outer perimeter of sole assembly 104 to perimeter 1604 provides additional surface area to facilitate attaching sole assembly 104 to a bottom of an upper. As shown in FIG. 17, sole assembly 104 is disposed on a carrier element 1700 that has a shape corresponding to perimeter 1604. Sole assembly 104 and carrier element 1700 may be associated with a bottom of an upper as described above to form an assembled article of footwear.

In some embodiments, a carrier element may be integrally provided with a sole assembly. Integrally provided carrier elements and sole assemblies may be made together using the same material or materials. Referring now to FIG. 18, in an alternate embodiment, an integrally molded carrier element 1800 may be provided that includes one or more of the raised components of sole assembly 1804, described above. In this embodiment, carrier element 1800 is molded together with one or more of components of sole assembly 1804, including one or more traction elements 108, central support structure 200 extending from first end 202 at forefoot region 10 to second end 204 disposed at heel region 14, plurality of forefoot wing portions 210, and/or plurality of stability rib portions 220, as described above, raised above a bottom surface 1806 of integrally molded carrier element 1800.

In one embodiment, integrally molded carrier element 1800 may be associated with a shape having a perimeter 1802 that generally corresponds with a bottom surface of an upper or a midsole or strobel. In this embodiment, perimeter 1802 of integrally molded carrier element 1800 provides a larger surface area than sole assembly 104 for facilitating attaching or joining integrally molded carrier element 1800 to an upper to form an assembled article of footwear.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A sole assembly for an article of footwear, the sole assembly having a forefoot region, a midfoot region, a heel region, a medial midfoot region, a medial side and a lateral side, and comprising:

a bottom surface;

a central support structure disposed longitudinally along the sole assembly from the forefoot region to the heel region, the central support structure being disposed on a ground-facing side of the bottom surface and extending away from the bottom surface in a vertical direction, wherein:

the central support structure has a thickness defined from the bottom surface in the vertical direction, and wherein the thickness continuously increases along an entire length of the central support structure (i) from the forefoot region to a maximum thickness at the midfoot region and (ii) from the heel region to the maximum thickness at the midfoot region;

the central support structure has a width defined in a lateral direction, and wherein the width continuously increases along the entire length of the central support structure from the heel region to a maximum width located in the forefoot region.

2. The sole assembly according to claim 1, wherein the thickness of the central support structure increases from a forefoot region thickness of approximately 1 to 3 mm to the maximum thickness of approximately 5 to 10 mm.

3. The sole assembly according to claim 1, wherein the thickness of the central support structure increases from a heel region thickness of approximately 3 to 8 mm to the maximum thickness of approximately 5 to 10 mm.

4. The sole assembly according to claim 1, wherein the sole assembly further comprises:

a plurality of forefoot wing portions disposed in the forefoot region of the sole assembly, wherein the forefoot wing portions extend away from the central support structure in the lateral direction; and a plurality of stability rib portions disposed in the midfoot region of the sole assembly, wherein the stability rib portions extend away from the central support structure in the lateral direction.

5. The sole assembly according to claim 1, wherein the width of the central support structure increases from a heel region width of approximately 2 to 8 mm to the maximum width of approximately 8 to 16 mm.

6. The sole assembly according to claim 1, wherein the central support structure includes a first end disposed in the forefoot region adjacent to an anterior end of the sole assembly and a second end disposed in the heel region adjacent to a posterior end of the sole assembly.

7. The sole assembly according to claim 1, wherein the thickness corresponding with a location of a maximum of the width is approximately half a maximum of the thickness, and wherein the width corresponding with a location of the maximum of the thickness is approximately half the maximum of the width.

8. A sole assembly for an article of footwear, the sole assembly having a forefoot region, a midfoot region, a heel region, a medial midfoot region, a medial side and a lateral side, the sole assembly comprising:

a central support structure disposed longitudinally along the sole assembly from the forefoot region to the heel region, wherein the central support structure is disposed on a bottom surface of the sole assembly and extends away from the bottom surface in a vertical direction a plurality of forefoot wing portions disposed in the forefoot region of the sole assembly, wherein the forefoot wing portions extend away from the central support structure in a lateral direction and extend away from the bottom surface in a vertical direction, and wherein the plurality of forefoot wing portions each includes a substantially planar ground-facing surface configured to support a traction element and defines a thickness extending from the bottom surface to the ground-facing surface in the vertical direction; and the thickness of at least one of the plurality of forefoot wing portions increases continuously from the central support structure towards a peripheral edge of the forefoot wing portion, wherein each of the plurality of forefoot wing portions includes a cut-out portion disposed between the central support structure and the peripheral edge;

wherein the cut-out portion separates the forefoot wing portion into a first leg attached to the central support structure at a first attachment edge and a second leg attached to the central support structure at a second attachment edge; and wherein the first leg is coupled to the second leg at the peripheral edge.

9. The sole assembly according to claim 8, wherein each of the plurality of forefoot wing portions increases in thickness from the central support structure towards a peripheral edge of the forefoot wing portion.

10. The sole assembly according to claim 9, wherein the thickness of the at least one of the plurality of forefoot wing portions increases from a thickness of approximately 1 mm to 3 mm to a thickness of approximately 3 mm to 6 mm.

11. The sole assembly according to claim 8, wherein an area defined by the cut-out portion is substantially triangular in shape.

12. The sole assembly according to claim 8, further comprising a plurality of stability rib portions disposed in the midfoot region of the sole assembly, wherein the stability rib portions extend away from the central support structure in the lateral direction.

13. A sole assembly for an article of footwear, the sole assembly having a forefoot region, a midfoot region, a heel region, a medial midfoot region, a medial side and a lateral side, and comprising:

a central support structure disposed longitudinally along a bottom surface of the sole assembly from the forefoot region to the heel region, wherein the central support structure extends away from the bottom surface in a vertical direction;

a plurality of stability rib elements disposed in the midfoot region of the sole assembly, wherein each of the stability rib elements extends away from the central support structure in a lateral direction and comprises a height and a width, the height defined from the bottom surface in the vertical direction, the width defined in the lateral direction extending toward a perimeter of the sole assembly; and wherein each stability rib element of the plurality of stability rib elements includes a first end along the central support structure, the first end of a first stability rib element of the plurality of stability rib elements having a first height defined from the bottom surface in the vertical direction, the first end of each of the remaining stability rib elements having a second height defined from the bottom surface in the vertical direction, the first height being different than each of the second heights, and wherein the width of each of the stability rib elements continuously increases in the lateral direction.

14. The sole assembly according to claim 13, wherein stability rib elements of the plurality of stability rib elements are spaced apart individually along the central support structure, and wherein gaps are disposed between adjacent stability rib elements.

15. The sole assembly according to claim 14, further including at least one reinforcing element disposed in at least one of the gaps.

16. The sole assembly according to claim 13, wherein the plurality of stability rib elements increase in height along the central support structure in a direction towards the heel region.

17. The sole assembly according to claim 13, wherein each stability rib element of the plurality of stability rib elements includes a second end opposite the first end along the lateral direction, and wherein at least one of the plurality of stability rib elements has a height at the first end that is greater than a height at the second end.

18. The sole assembly according to claim 13, wherein the plurality of stability rib elements disposed along the central support structure have heights that vary between approximately 2 mm to 12 mm.

* * * * *